US010023207B2

(12) United States Patent
Brown

(10) Patent No.: US 10,023,207 B2
(45) **Date of Patent: *Jul. 17, 2018**

(54) ZIP LINE APPARATUS

(71) Applicant: NORTH STAY, LLC, Bow, NH (US)

(72) Inventor: Stephen Douglas Brown, Bow, NH (US)

(73) Assignee: North Stay, LLC, Bow, NH (US)

( * ) Notice: Subject to any disclaimer, the term of this patent is extended or adjusted under 35 U.S.C. 154(b) by 90 days.

This patent is subject to a terminal disclaimer.

(21) Appl. No.: 14/536,640

(22) Filed: Nov. 9, 2014

(65) Prior Publication Data

US 2015/0059611 A1 Mar. 5, 2015

Related U.S. Application Data

(63) Continuation-in-part of application No. 12/879,700, filed on Sep. 10, 2010, now Pat. No. 8,985,027.

(60) Provisional application No. 61/320,668, filed on Apr. 2, 2010.

(51) Int. Cl.

| | |
|---|---|
| ***B61H 1/00*** | (2006.01) |
| ***A63G 21/22*** | (2006.01) |
| ***B61B 12/02*** | (2006.01) |
| *A62B 35/00* | (2006.01) |

(52) U.S. Cl.

CPC ..... *B61H 1/00* (2013.01); *A63G 21/22* (2013.01); *B61B 12/02* (2013.01); *A62B 35/0081* (2013.01); *Y10T 29/49826* (2015.01)

(58) Field of Classification Search

CPC ... A63G 7/00; A63G 9/00; A63G 9/02; A63G 9/04; A63G 9/12; A63G 9/16; A63G 9/22; A63G 21/00; A63G 21/04; B61B 7/00; B61B 7/04; B61B 11/00; B61B 12/12

See application file for complete search history.

(56) References Cited

U.S. PATENT DOCUMENTS

| | | | | |
|---|---|---|---|---|
| 547,528 | A | 10/1895 | Weaver et al. | |
| 599,697 | A | 3/1898 | Foster | |
| 1,087,062 | A | 3/1913 | Izelt | |
| 1,087,063 | A | 4/1913 | Izelt | |
| 1,935,711 | A | 4/1930 | Hecox et al. | |
| 3,192,872 | A | 7/1965 | Parent | |
| 4,442,918 | A | 4/1984 | Rhoads, Sr. | |
| 4,948,118 | A | 8/1990 | Miraglia | |
| 5,094,171 | A | 3/1992 | Fujita | |
| 5,224,426 | A | 7/1993 | Rodnunsky et al. | |
| 5,931,100 | A | 8/1999 | Sutton | |
| 6,053,457 | A * | 4/2000 | Ozga | G02B 6/50 248/58 |
| 6,779,630 | B2 * | 8/2004 | Choate | A62B 35/0056 182/3 |
| 6,805,220 | B2 * | 10/2004 | Fulton | A62B 35/0056 182/3 |
| 7,381,137 | B2 | 6/2008 | Steele et al. | |

(Continued)

*Primary Examiner* — Robert J McCarry, Jr.
(74) *Attorney, Agent, or Firm* — Z IP Law PLLC

(57) ABSTRACT

Embodiments of the present invention generally relate to a zip line or trolley system kit for propelling a person or an object using gravity along an extended cable line suspended between two trees or towers. The zip line or trolley system may include an easily installable support harness assembly, a braking system and a removable seat fixture to provide for the zip line system to be completely portable to be carried, installed and taken down in remote locations.

21 Claims, 34 Drawing Sheets

(56) References Cited

U.S. PATENT DOCUMENTS

| | | | | |
|---|---|---|---|---|
| 7,966,941 | B1 | 6/2011 | Brannan | |
| 8,336,463 | B2 | 12/2012 | Smith | |
| 8,424,460 | B2 | 4/2013 | Lemer | |
| 8,601,951 | B2 | 12/2013 | Lemer | |
| 8,985,027 | B2 * | 3/2015 | Brown | A63G 21/20 104/112 |
| 2002/0162477 | A1 | 11/2002 | Palumbo | |
| 2009/0078148 | A1 * | 3/2009 | Cylvick | A63G 7/00 104/53 |
| 2009/0255436 | A1 | 10/2009 | Buckman | |
| 2013/0118842 | A1 | 5/2013 | Lerner | |
| 2013/0220743 | A1 | 8/2013 | Headings | |
| 2013/0327242 | A1 | 12/2013 | Bemier | |
| 2014/0311376 | A1 | 10/2014 | Brannan | |

* cited by examiner

30

22
50
47
74
46
48

76
26
50

11
16
62
40
72
39
44
38
42
78
80

20

54
52
58
12

ZIP LINE APPARATUS

CROSS-REFERENCE TO RELATED APPLICATIONS

This application is a continuation-in-part of U.S. patent application Ser. No. 12/879,700, filed Sep. 10, 2010, entitled "ZIP LINE APPARATUS" and claims priority to U.S. provisional patent application Ser. No. 61/320,668, filed Apr. 2, 2010, entitled "ZIP LINE KIT" the disclosures of which are incorporated by reference herein in their entireties.

FIELD OF THE INVENTION

The invention relates to a trolley for guiding a person or an object using gravity along an extended cable line suspended between two spaced apart objects such as trees or towers, and more specifically relates to a zip line kit or system with an easily adjustable and removable seat and handle arrangement which in combination with a wheel and braking system for the device facilitates a safe and controllable descent along the cable line. The trolley is provided with at least two wheels spaced apart at a suitable distance to increase ride smoothness, provide sufficient space to accommodate the braking system and improve operation of the zip line system along the extended cable. The invention includes a ratchet tensioning system to more easily install, tighten and maintain the tension of the extended cable. The zip line system is also easily assembled and installed to and from the cable using a unique seat attachment fixture referred to herein as a seat ring or seat clamp that makes the zip line system completely portable for installation in remote locations.

BACKGROUND

A zip line system is a work or recreational device which allows a user to maneuver or traverse themselves, or another person, object or load by use of a trolley along a suspended line or cable generally from a higher point of elevation to a lower point of elevation using gravity, although the trolley, person, object or load may be moved in any direction along the suspended line or cable depending on the use of different forces, arrangement of the zip line system and necessity. The line or cable can be a rope, steel cable, wire or other similar elongate support, even a rigid elongate support such as a steel or wooden beam, which can be extended between two points. The line or cable and zip line system generally permits travel of the trolley along the vector defined by the cable or line. The trolley has at least a wheel and preferably a plurality of wheels rotatably supported by the trolley which in turn support the trolley upon the line or cable.

The trolley may be permanently and/or removably supported by the cable and will generally include at least a handle, sling, harness or netting affixed or suspended from the trolley to support the person, load or object. Commercial trolleys for instance for mountain climbing and eco-tourism like jungle canopy tours use a trolley to which a safety harness is secured. The safety harness is a support which is merely a set of fabric straps that are adjusted around the legs and buttocks of a person with a suspension strap that connects to the trolley or pulley system. The person is directly suspended from the trolley system and must hold onto the suspension strap as they traverse the zip line.

Known zip line systems do not have a seat to comfortably support the rider during the traverse, nor an adjustment mechanism which makes the seat easily adjustable for people of different sizes. Usually the rider dangles within the harness directly from the trolley system. Known zip line systems also generally do not have any type of handle for a rider to hold directly onto the trolley while they are also supported by the adjustable seat.

Additionally, known zip line systems do not have any type of braking system in the trolley itself and the user has little or no ability to slow themselves down, or even stop themselves during the traverse. In most current systems a rubber or cushioned bumper is positioned at the base of the cable to intercept and stop the trolley from sliding further down the cable. Most systems further affix the cable to a tree tower or other support by looping the cable through a steel ring and twisting a wire, clamping the cable, or otherwise fastening the cable to itself to suspend the cable. These current features provide little safety or control to the user and require lengthy installation or removal of the system thus there exists a need for an improved zip line system that is more easily installed and that includes portability features and easy installation and adjustment to the cable assembly. The zip line system may include a trolley, a seat support with a seat clamp that makes installation and removal of the trolley and the seat effortless, and an improved braking safety device to slow the descent of the trolley and person, load or object traversing along the cable of the zip line system.

OBJECTS AND SUMMARY OF THE INVENTION

The zip line system of the present invention may be offered as a completely assembled unit or a kit with various components including for example the trolley, a braking system, handle, webbing, a seat and a trolley return line. Other components of the system could include but are not limited to a safety harness, a cable assembly system as well as structural accessories, fasteners and tools such as a come-along and cable cutters which facilitate constructing and suspending the cable between two points. The come-along or ratchet provides for installation, adjustment and removal of the cable in a relative short amount of time making the zip line system portable for installation in remote locations.

The zip line kit has an improved trolley system that supports at least one, and preferably two or more wheels or pulleys sandwiched between two frame pieces. The frame pieces can be manufactured of aluminum or other metal, certain rigid plastics or other stiff durable materials such as carbon fiber could be used as well. The frames are affixed to one another sandwiching the wheels therebetween. The frames can be removably affixed for instance by bolts, screws or other such fastening devices. The frames can be permanently connected for instance by rivets or welding or even hingedly connected by a hinge or quick-release and fastening system which allows the frames to hinge along parallel or non-parallel planes with respect to one another. Such a hinge connection may facilitate taking the trolley on and off a cable without having to take the cable down or completely take the trolley apart.

In any event the trolley is securely affixed to and supported on the cable, line, rope or wire with the cable inserted through, i.e. generally in a planar relation between the two frame pieces and below the wheels, so the wheels rest on the top of the cable and support the trolley so that it can roll efficiently along and traverse the cable. It is to be appreciated that there could be an additional wheel or wheels below the cable to facilitate maintaining the trolley tracking along the cable.

A handle is secured through each of the frame pieces using cushioned grips, improving the comfort, and grip of the handle for the rider. Alternatively, a dual piece handle may be formed by engaging threadable sections which engage with one another, or which engage directly with frame pieces. The frame pieces also support fabric webbing, although a cable or rope may also be contemplated, that extends from the base of each of the frame pieces to support a seat for the zip line rider beneath the trolley. This adjustment allows the seat to be positioned at a desired distance below the handle for a rider to comfortably hold the handle essentially above their head while seated. The seat may be of aluminum, another metal or of a plastic composite with an ergonomic shape to allow for a rider to sit comfortably.

In further embodiments, the fabric webbing that supports the seat is inserted through a slot in the seat and extended to an appropriate length and then folded in half with the distal end inserted through the same or a second slot in the seat. The ends of the webbing are then sewn together or folded over and sewn to create a thickness of the webbing that is greater than the slot to prevent the webbing from being pulled out and through the slot. In this manner the webbing may be permanently attached to the seat. The half fold in the webbing is then inserted into and secured to a seat ring or seat clamp that has an opening to provide for the handle to be inserted through one side of the frame through the seat clamp and through the other side of the frame. This unique attachment for the seat allows for the handle to be removed from the frame and the seat clamp to be slid out from between the frame pieces to remove the seat from the trolley. This construction provides for the seat to be easily removed for safety, so that a user such as a small child does not attempt to ride the zip line without supervision. The easy attachment also provides for portability of the zip line, so that a cable could be extended in a remote location between any two suitable support structures such as trees or towers and the trolley could be mounted to the cable and the handle inserted through the frame and seat clamp to quickly and easily attach the seat, without the necessity of tools or disassembly of the trolley. Portability of the system and easy installation and removal is further supported by the quick release come-along or ratchet system that reliably and securely installs the zip line cable to the support structures.

The present invention further provides an innovative braking system with an actuator to allow a user to slow the speed of the trolley when descending or completely stop the trolley. The braking system is spring loaded or uses a high-strength heat and weather resistant elastic made from for example an ethylene propylene diene monomer (EPDM) rubber. In an embodiment the elastic is suspended from a pin or bolt inserted within a slot of the braking system support that holds the brake pad above the zip line cable. The elastic is affixed to each end of the support so that when actuating, the user pulls finger levers down to have the brake pad contact the cable. When the levers are released, the elastic pulls the brake pad and braking support away from the cable. The brake pad may be of a polyester based polyurethane. The hardness of the composite will reduce degradation as the pad is held against the cable by the user while descending. In some embodiments, the brake pad may have the unique feature of a perforation of openings in the frictional surface of the brake pad. As degradation of the pad from friction along the cable occurs over long periods of use, material between the perforated openings may fuse and fill the openings extending the life of the brake pad. The brake pad is removable from the braking support for replacement as needed. In other embodiments a tension or leaf spring instead of an elastic may be used to reset the brake pad to an unactuated position above the cable.

It is an object of the present invention to provide a trolley for a zip line system including a braking system including a brake pad and actuator to control the amount of braking desired by the rider as the rider slides along the cable.

It is an object of the present invention to provide a brake pad of high hardness to reduce degradation when heated due to friction along the cable to extend the life of the pad.

It is another object of the present invention to provide an improved zip line system and trolley for traversing a cable with the trolley having an increased distance between each wheel to permit the trolley to more efficiently traverse the cable and permit the braking system to be located between the spaced apart wheels.

It is another object of the present invention to provide a zip line system with an easily adjustable seat to more comfortably accommodate riders of different sizes.

It is another object of the invention to provide a seat clamp attached to the trolley using a removable handle to quickly and easily install and remove the seat for safety or portability of the zip line system.

It is still another object of the present invention to secure the pulley system of the zip line within a quick release trolley frame to allow the trolley to be easily secured and removed from a cable, rope or wire.

It is yet another object of the present invention to have a braking system which a rider activates to slow the descent of the zip line along the cable or wire.

It is still yet another object of the present invention to have a braking system which a rider actuates to slow the descent of the zip line along the cable or wire.

It is a further object of the present invention that an embodiment of the invention has a brake pad with a lining to increase frictional resistance while reducing wear on the wire or cable.

It is a further object of the present invention that an embodiment of the invention has a braking system that when activated curbs the rotation of the pulley to slow the descent of the zip line system.

It is a further object of the present invention that an embodiment of the invention has a braking system with a brake pad that when activated drags the brake pad along the cable to slow the descent of the zip line system.

It is a still further object of the invention that the wire or cable is supported using a quick-release ratchet to easily put up and take down the wire or cable when the zip line is not in use.

The present invention is directed to trolley for traversing a zip line system comprising a frame including at least two wheels rotatably affixed to the frame; a brake affixed to the frame for engaging an object supporting the trolley in the zip line system; a handle secured to the frame permitting a user to grasp the trolley; an adjustable seat secured to the frame; and wherein the brake is actuated by the user while grasping the handle of the trolley to control the descent of the user and the trolley along the zip line system.

The present invention is also directed to a method of carrying a person or object along an extended wire comprising the steps of attaching a pulley system to a frame, the pulley system adequate to roll along the wire; attaching a braking system to the frame to control the speed of the person or object along the wire; attaching a seat using fabric webbing to the frame, the fabric webbing being adjustable to change the distance of the seat from the frame; and attaching a handle to the frame.

The present invention is further directed to a kit for a zip line system comprising a frame; a pulley system; a braking system; one or more straps of fabric webbing; an adjustable seat; and a handle.

The present invention is further related zip line system comprising a frame supported on a suspended cable; at least one pulley supported by the frame; a handle attached to the frame; and a braking system that when activated curbs the rotation of the pulley to slow the descent of the zip line system. The braking system of the zip line system may comprise a brake pad and the brake pad may be replaceable. The frame of the zip line system may be removable from the cable by removing the handle. The zip line system may comprise a seat with a seat fixture removably attached to the frame using the handle.

The present invention is further related to a portable zip line system comprising a trolley having at least two wheels rotatably affixed between two frames; a cable assembly for extending a cable between two structural supports, the cable suitable to support the at least two wheels within the trolley; a seat fixture aligned between the two frames of the trolley; a handle inserted through the trolley to secure the seat fixture to the trolley; and an adjustable seat affixed to the seat fixture. The seat fixture of the portable zip line system may be removable from the trolley by removing the handle to have the zip line system be portable. The trolley of the portable zip line system may be removable from the cable by pulling the at least two wheels up and away from the support of the cable to have the zip line system be portable. The cable assembly of the portable zip line system may be removable from two structural supports using a ratchet to have the zip line system be portable. The portable zip line system may comprise a braking system affixed to the trolley. The braking system may comprise a distributive structural support frame. The braking system may comprise a replaceable brake pad. The braking system may comprise an actuator that causes the replaceable brake pad to come in contact with the extended cable. The replaceable brake pad of the braking system may comprise perforated openings. The brake pad may comprise a heat resistant material. The braking system may comprise an elastic member. The seat fixture of the portable zip line system may have a circular support for the webbing of the seat. The handle may have an attachment mechanism that releasably affixes the handle to the trolley. The seat of the portable zip line system may be flexible. The fabric webbing strap may be adjustable to shorten or lengthen the distance from the seat to the trolley.

The present invention is related to a method of assembly of a portable zip line system comprising the steps of rotatably affixing at least two wheels between two frames to form a trolley; extending a cable between two structural supports using ratchets, the cable suitable to support the at least two wheels within the trolley; aligning a seat fixture between the two frames of the trolley; inserting a handle through the trolley to secure the seat fixture to the trolley; and affixing an adjustable seat to the seat fixture. The method of assembly of a portable zip line system comprising the step of removing the seat fixture from the trolley by removing the handle. The method of assembly of a portable zip line system comprising the step of removing the trolley assembly from the cable by pulling the at least two wheels up and away from the support of the cable. The method of assembly of a portable zip line system comprising the step of removing the cable from two structural supports using the ratchets. The method of assembly of a portable zip line system comprising the step of affixing a braking system to the trolley.

The present invention is related to a portable zip line system comprising a cable assembly having a cable and ratchet system; a trolley supported by the cable; a handle attached to the trolley; and a seat affixed to a seat fixture removable from the trolley by removing the handle. The trolley of the portable zip line system may be removable from the cable by removing the handle and pulling the trolley up and away from the cable. The trolley may have at least one pulley rotatable on the cable. The cable assembly of the portable zip line system may be removable from two structural supports using the ratchet system. The portable zip line system may comprise a braking system with a brake pad that when activated drags the brake pad along the cable to slow the descent of the zip line system. The braking system of the portable zip line system may comprise a distributive structural support frame that transfers forces evenly and smoothly in slowing the zip line system. The brake pad of the portable zip line system may be replaceable and may comprise a heat resistant material. An actuator of the braking system of the portable zip line system may be supported by an elastic member. The handle of the portable zip line system may have a releasable attachment mechanism that secures the handle to the trolley. The seat of the portable zip line system may be flexible and adjustable.

The present invention is further related to a method of assembly of a portable zip line system, comprising the steps of installing a cable to two structural supports using a ratchet system; aligning at least one pulley of a trolley on the cable, the at least one pulley attached between two frames of the trolley; affixing a seat to a seat fixture; aligning the seat fixture between the two frames of the trolley; and inserting a handle through the trolley and the seat fixture to secure the seat to the trolley. The method of assembly of a portable zip line system may comprise the step of removing the seat and seat fixture from the trolley by removing the handle. The method of assembly of a portable zip line system may comprise the step of removing the trolley from the cable by pulling the at least one pulley of the trolley up and away from the cable. The method of assembly of a portable zip line system may comprise the step of removing the cable assembly from two structural supports using the ratchet system. The method of assembly of a portable zip line system may comprise the step of affixing a braking system to the trolley.

These and other features, advantages and improvements according to this invention will be better understood by reference to the following detailed description and accompanying drawings.

BRIEF DESCRIPTION OF THE DRAWINGS

Several embodiments of the present invention will now be described by way of example only, with reference to the accompanying drawings in which.

DETAILED DESCRIPTION

Embodiments of the present invention relate to a trolley for guiding a person or an object using gravity along an extended cable line suspended between two spaced apart objects such as trees or towers, and more specifically relates to a zip line kit or system with an easily adjustable seat and handle arrangement which in combination with a wheel and braking system for the device facilitates a safe and controllable descent along the cable line. The trolley is provided with at least two wheels spaced apart at a suitable distance to increase ride smoothness, provide sufficient space to accommodate the braking system and improve operation of the zip line system along the extended cable.

Figure 1:
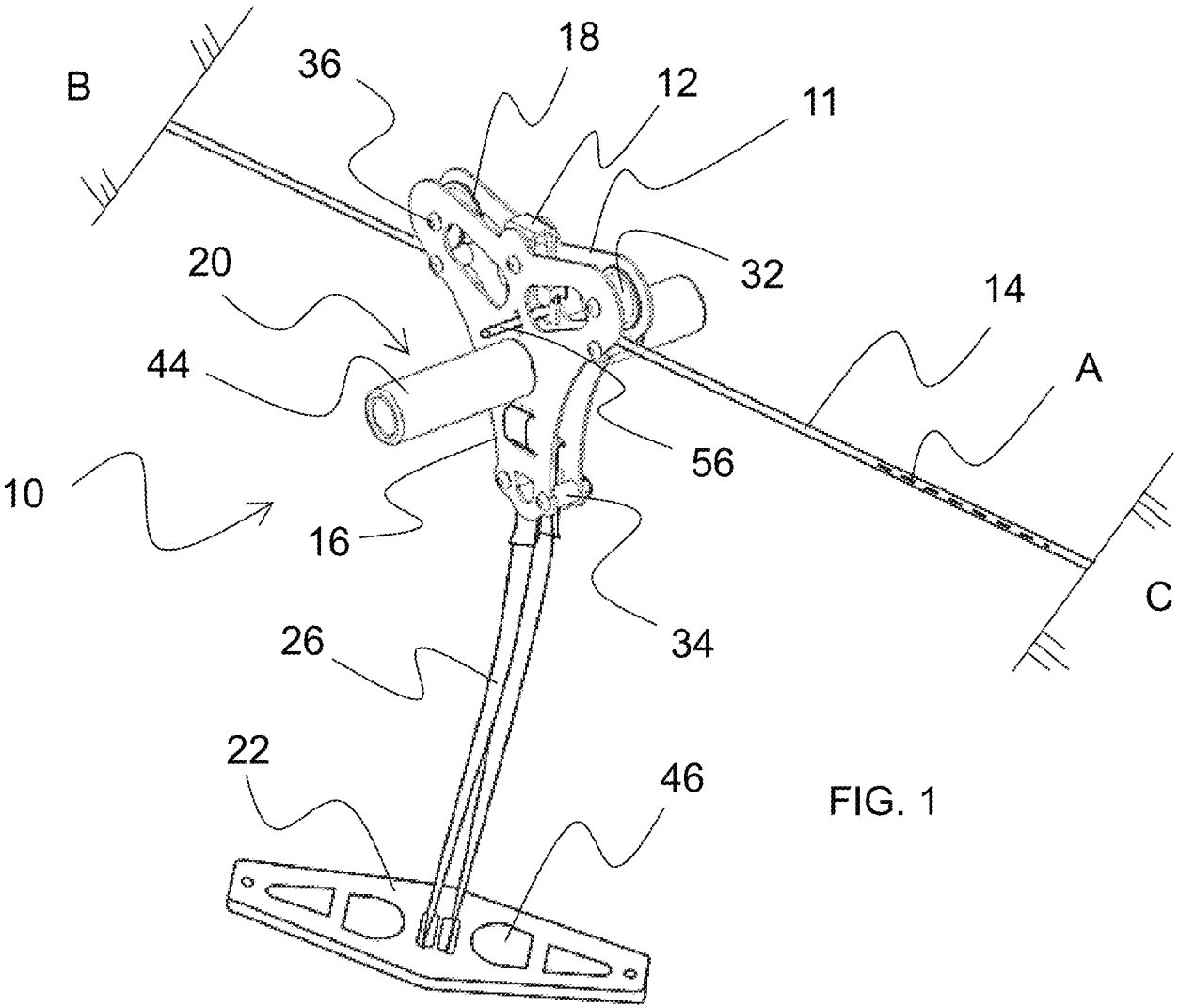
FIG. 1 is a perspective view of an embodiment of the zip line system of the present invention.

FIG. 1 shows in general a zip line system 10 of the present invention including a trolley 11 with a braking system 12 supported on an extended cable 14. The trolley 11 comprises two frame pieces 16 that house one or more wheels 18 for engaging the cable 14. The cable is understood to be in one embodiment an extended steel cable, but could alternatively be a rope, line, rail or wire, but for purposes of description is hereinafter referred to as cable 14. The cable is fastened at either end between two spaced apart points B-C to generally define a longitudinal travel axis A for the trolley. The trolley 11 may also include a braking system 12, handle 20, a seat 22 and an adjustment mechanism 26 facilitating changing the spacing between the seat 22 and the trolley 11.

Figures 2, 2A, 2B, 2C, 2D, 2E:
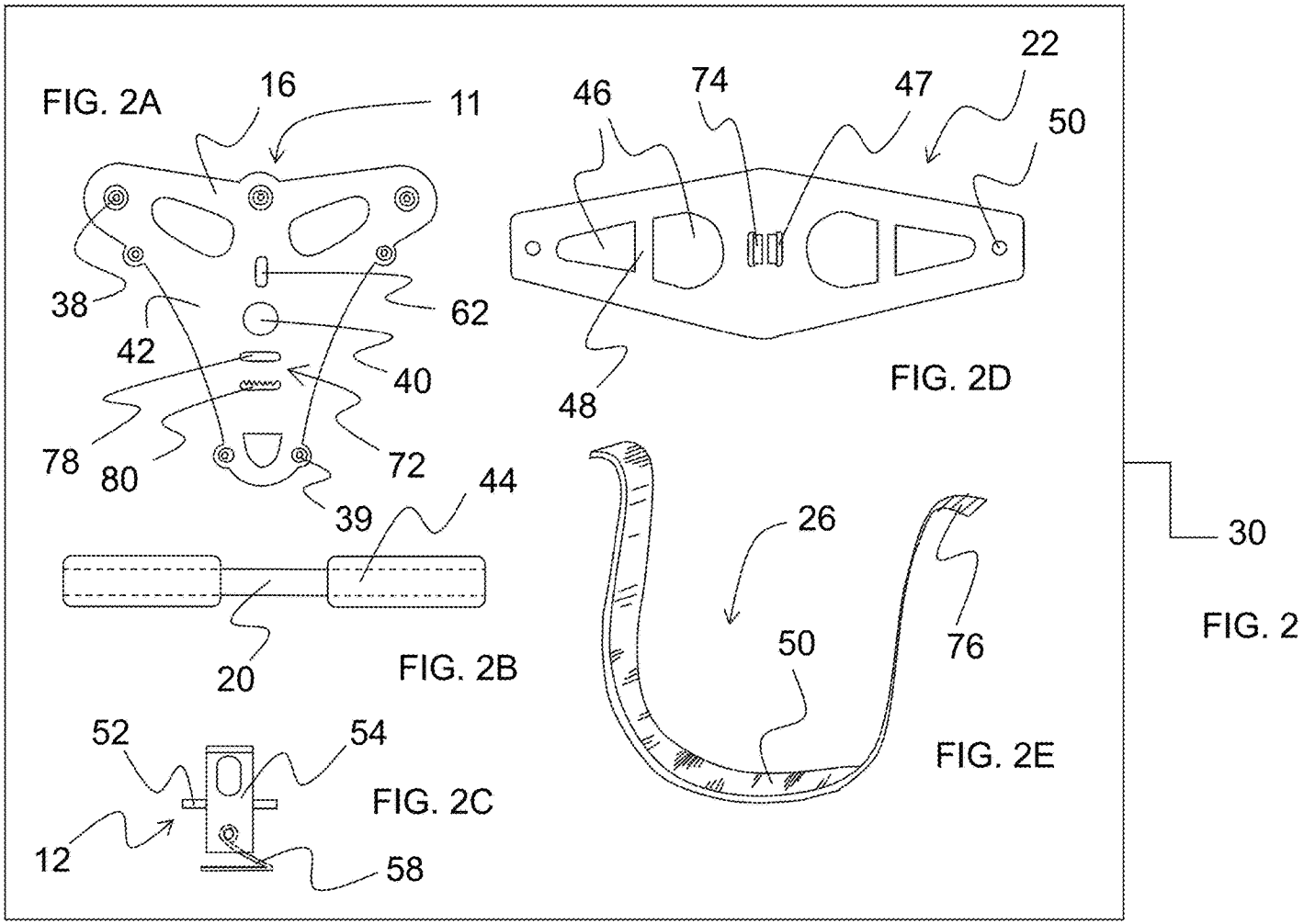
FIG. 2 is an embodiment of the zip line system kit.
FIGS. 2A-2E are views of the components of the zip line system kit of the present invention, including a frame, a handle a braking system, a seat and a suspension strap, respectively.

A basic zip line kit 30 is shown in FIG. 2 and the components of the kit 30 are shown in FIGS. 2A-2E comprising the trolley 11, handle 20, braking system 12, seat 22, and adjustment mechanism 26, respectfully. The kit 30 could alternatively include more or less components, for example, the kit might not contain the braking system 12 if such a braking system where not necessary or desired in a certain zip line application. The kit could, by way of example, also include additional components like the cable 14 and parts for securing and extending the cable 14 between the points B-C.

The generally triangular shaped frame pieces 16 of the trolley 11 as shown in FIG. 2A define a series of pivot points 38, attachment points 39 as well as other openings and slots to facilitate the attachment of the wheels 18, secure the opposing frame pieces 16 together and position the braking system 12, handle 20, seat 22 and adjustment mechanism 26. Pivot points 38 are positioned at what are defined here as the upper opposing corners of the trolley 11 to rotatably attach the wheels 18 between the triangular shaped frame pieces 16. Two wheels 18 are used in the preferred embodiment although additional pivot points and wheels may be configured and overall dimensions of the frame pieces 16 may be altered to accommodate alternative configurations.

The center portion of the trolley has an opening 40 for the handle 20 to be inserted through or bolted onto the frame 16, the handle 20 may be a metal, wood or other similar rigid material bar or rod, which is inserted through the opening 40 so as to extend perpendicularly relative to the planar surface 42 of the frame 16 as shown in FIG. 1. The handle 20 may be round, or other profile such as square or rectangular with the opening 40 similarly designed, and be of a various diameter or width to comfortably accommodate the hands of a rider 24 gripping the handle 20 by wrapping their fingers around the handle 20.

The handle 20, as shown in FIG. 2B, may have a removable cushioned grip 44 that is slid onto or affixed onto the handle 20, providing comfort to the rider 24 and helping to secure the handle in the opening 40 where the ends of the grips 44 abut against the portion of the frame 16 surrounding the handle opening 40. In this way, the opening 40 in the frame 16 for the handle 20 may be of a diameter smaller than an outer circumference of the grip 44 providing for the grip 44 to maintain the handle 20 in the opening 40 with the trolley 11. The grip 44 may be of a stiff foam or rubber that tightly adheres to the handle 20, but is generally manually removable if necessary to remove the handle 20 from the trolley 11.

One embodiment of a seat 22 and the adjustment mechanism 26 as flexible fabric webbing is shown in FIGS. 2D and 2E. The seat 22 may be of any ergonomical design and material to comfortably and safely support a rider 24. In the embodiment of FIG. 2D, the seat is designed to be sat upon by the rider with the seat 22 arranged under the user's hamstrings and/or gluteus maximus. The general diamond shape of the seat 22 here facilitates the rider sitting upon the seat and essentially straddling the webbing of the adjustment mechanism 26. The seat 22 may be other shapes, and may be rigidly formed from a piece of metal, such as aluminum, or the seat may be flexible, i.e. a flexible fabric or plastic such that the flexible seat conforms to the riders body size and shape. This is an important safety consideration since a flexible seat would be able to bend around the body proportions of any size rider from child to adult, and securing them closely without changing the size of the seat for different riders. In either a rigid seat or a flexible seat, the seat may have cutouts 46, slots 47 or other openings 50, which define alternative securing points to allow flexibility in attachment of the seat 22 to the adjustment mechanism 26.

The adjustment mechanism 26 is in one embodiment fabric webbing 50 of a reasonable length, generally between for instance 2.44 m-4.57 m (8-15 feet) long, to provide sufficient adjustment between the seat and trolley for the size of the rider. The critical distance for which the adjustment mechanism 26 is adjusted is based on the extension of the rider's arms over their head to grasp the handle 20 while sitting on the seat 22 so that their head is entirely below the trolley. In other words it is the distance between the handle 20 and the seat 22 which permits the rider to sit comfortably on the seat 22 and reach over their head and grasp the handle 20 so that they are securely suspended below the trolley 11 and upon the seat 22. For a child the webbing would be adjusted to shorten the distance between the seat and trolley, and for an adult of course the webbing 50 would be lengthened to provide a greater distance therebetween.

Although other ways of adjusting the relative seat and trolley distance are possible, webbing is a good choice for the adjustment mechanism because of its flexibility and tensile strength. The flexibility enables the user to easily adjust the length of webbing to accommodate a rider. Webbing is inexpensive, strong and available in a myriad of widths. An appropriate size for the adjustment mechanism 26 is a width of between about 1.91 cm-3.81 cm (¾" to 1/½") and preferably 1" with a tensile strength of ~15 kN-~35 kN (~3000 lb.-~7000 lb.) and more specifically a tensile strength of ~20 kN (~4000 lb.). The webbing is preferably resistant to mildew, aging and abrasion. Alternative adjustments and attachments of the frame to the seat are discussed in detail below.

The braking system 12 as shown in one embodiment in FIG. 2C is also supported within the frame 16 of the trolley 11 and generally includes a brake pad 52 aligned anywhere adjacent the cable 14 for contacting the cable, although the most practicable alignment is above or below the cable 14 for contacting the cable 14 when the braking system 12 is operated by the rider. The brake pad 52 may have a contact length which depends on the amount of friction desired to be generated during braking operations. The contact length of the brake can be extended to the full length between the wheels 18 or to any desired length to sufficiently contact the cable 14 and create a frictional resistance to slow the trolley system 10 down upon actuation of the braking system. The brake pad 52 may be retained and float above the cable 14 using a tension spring or below the cable 14 resting on support or spacer 34 prior to activation. By floating adjacent the cable the brake pad 52 may be in light contact with the cable 14 and ride along the cable without creating much braking friction until energized by the rider. The brake pad 52 may also be provided with a contact surface which is angled or curved to provide additional frictional contact with the cable 14.

Figure 3A:
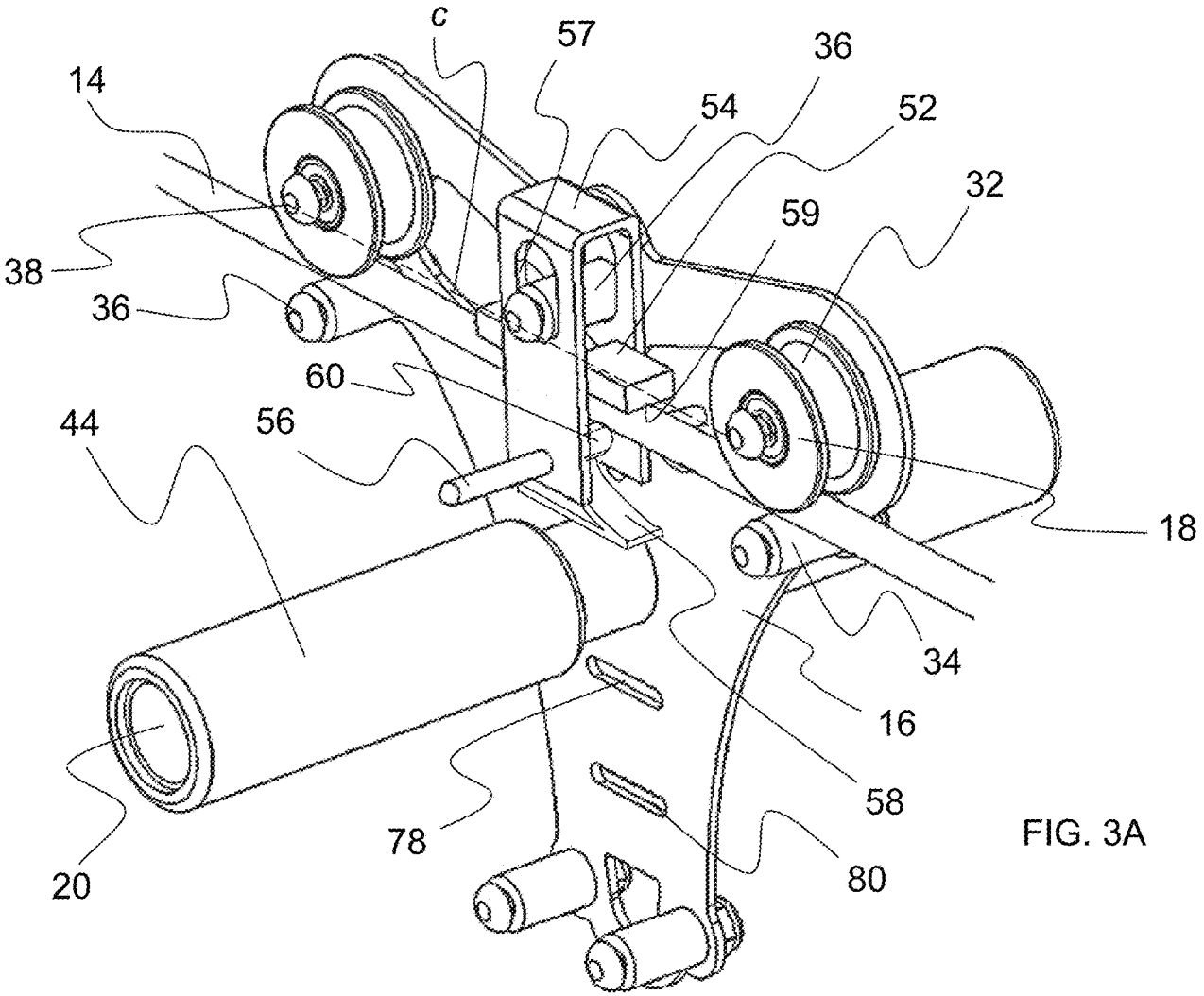
FIG. 3A is a perspective view of a first embodiment of the frame and brake assembly for an embodiment of the zip line system of the present invention.

Turning to FIG. 3A, in one embodiment, the two wheels 18 may be positioned at the upper corners of the trolley 11 providing spacing between the pivot points 38 in a range of at least 10.2 cm to 20.3 cm (4" and 8") and more specifically at a distance c of 11.4 cm to 14 cm (4½" to 5½"). The wheels 18 are secured in the trolley 11 and thus along the cable 14 at an increased distance relative to known zip line systems so that rider, load or weight is distributed along a greater length and surface area of the cable 14 reducing tension and bending of the cable, giving the rider a smoother ride. The wheels 18 are generally fabricated of stainless steel, brass or other durable material with sealed, internal or external bearings 27 to optimize rolling and rotation of the wheels and trolley along the cable 14. Such wheels 18 are often referred to as a sheave which is a wheel or roller with a groove 32 along its edge for engaging a belt, rope or cable 14. When hung between two supports equipped with a belt, rope or cable 14, one or more sheaves make up a pulley, or as in this case are embodied as the trolley 11. The words sheave and pulley may be sometimes used interchangeably.

Spacers 34 may be positioned between the frame and the connecting bolts 36 of the frame 16 and additionally at an offset to the pulleys 18 to act as a guide for the cable 14 along the pulley 18. Optionally runners or brackets (not shown) may also be positioned offset from the pulleys to act as cable guides.

Figure 3B:
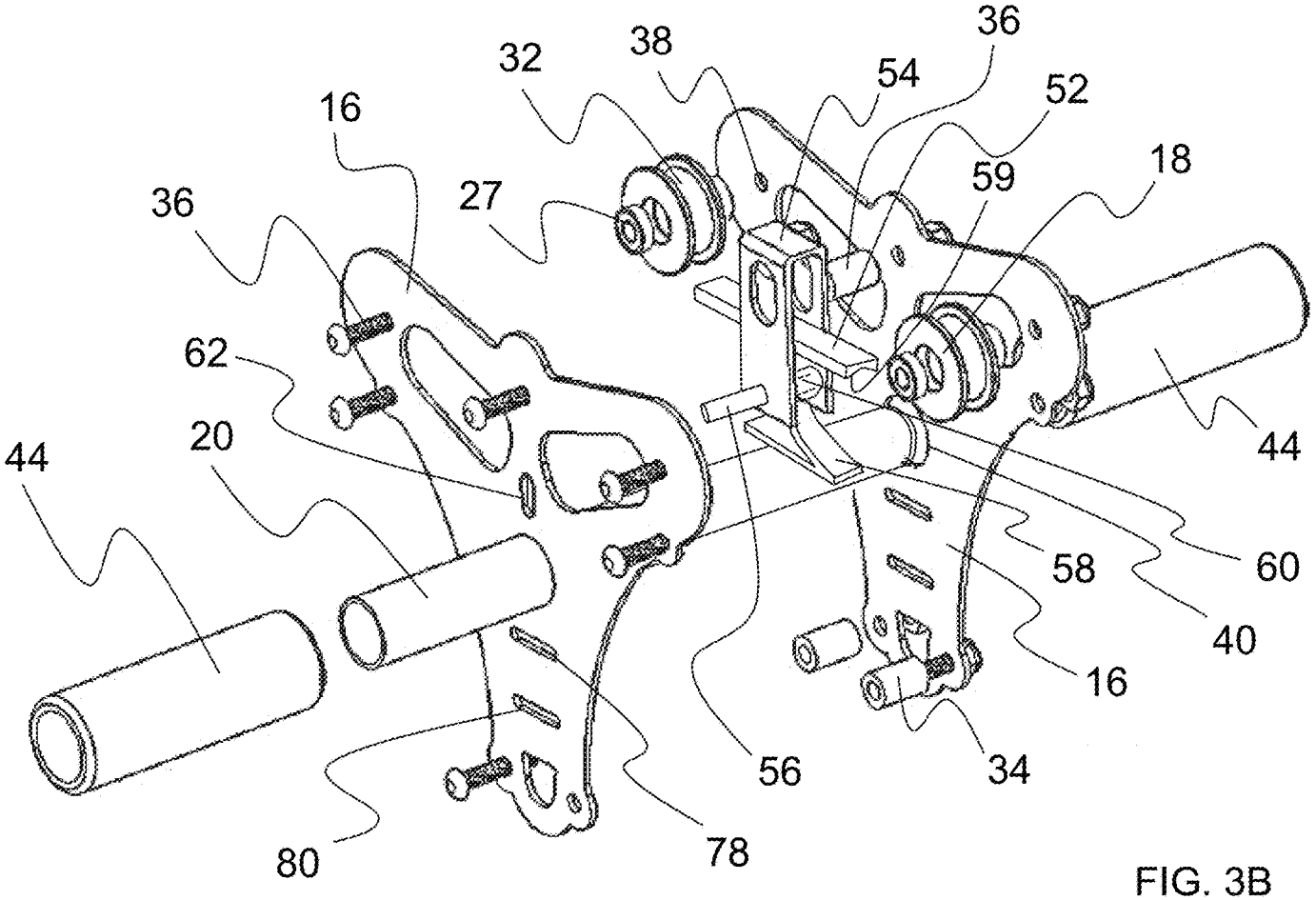
FIG. 3B is an exploded view of a first embodiment of the frame and brake assembly for an embodiment of the zip line system of the present invention.
Figure 3C:
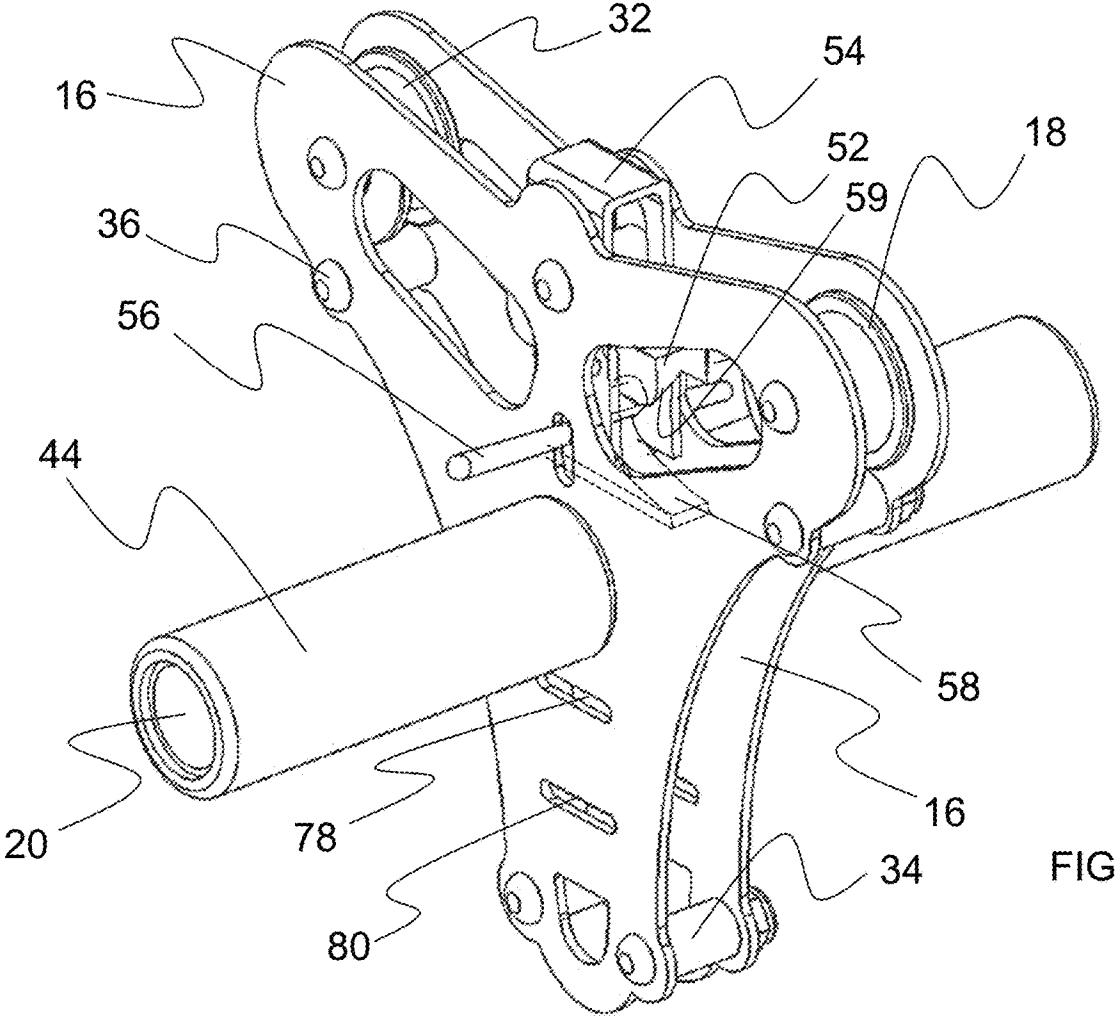
FIG. 3C is a perspective view of an embodiment of the zip line system with a first embodiment of the frame and brake assembly.

In the embodiment as shown in FIGS. 3A-3B, a U-shaped brake frame 54 is affixed in the frame 16 by a center connecting pin 36 and the brake frame 54 supports the brake pad 52 above the cable 14. The brake frame 54 has an elongate slot 57 in which the center connecting pin 36 permits the brake frame 54 to move linearly up and down. In this embodiment, a leaf spring 58 is depicted, although any spring or retention support may be contemplated, to maintain the brake frame 54 in a disengaged position shown in FIG. 3A. The leaf spring 58 has one end abutting the handle 20 and another end biasly engaging the brake frame 54 to maintain the brake frame 54 in a normally raised position, holding the brake pad 52 above, or in very slight or tenuous contact with the cable 14. The brake pad has a cable engaging surface 59 and may be formed from a metal bar of steel, aluminum or other metals as shown in FIG. 3A. The cable engaging surface 59 may be flat or it may be angularly formed or rounded to increase the overall contact area of the brake pad 52 with the cable 14 as shown in FIG. 3B-3C. The brake pad cable engaging surface 59 may have a lining of a heat resistant material with a desired durability and coefficient of dynamic friction in a range of 0.35 to 0.42 meaning a force of 1000 kg (or pounds) will result in a brake force close to 400 kg (or pounds).

As shown in an exploded view of the frame 16 and brake system in FIG. 3B, the actuator 56 is coupled to the brake frame 54 and inserted through both legs of the U-shaped brake frame as shown. A central portion 60 of the actuator 56 provides a bearing or attachment point for a second end of the leaf spring 58 so that the leaf spring can directly influence the brake frame 54. Alternatively, the second end of the leaf spring 58 can be directly affixed to the brake frame 54.

The actuator 56 is essentially a trigger for the user to actuate the brake. The ends of the actuator 56 pass through a brake pin slot 62 in each frame piece 16, where the slot 62 is located above the handle opening 40 to allow for a rider 24 to easily grasp the brake actuator 56 with one or more fingers while still holding the handle 20. In the present embodiment, with their hands grasping the handles 20, the rider 24 can easily extend their pointer finger on either side of the trolley to engage the actuator 56 while continuing to maintain their grip on the handle 20. In this way the rider can compress the actuator 56 to pull down the brake frame 54 and brake pad 52 against the bias of the leaf spring 58 and so fully engage the brake pad 52 with the cable 14. As the brake pad 52 contacts the cable 14, frictional resistance between the brake pad 52 and cable 14 is increased creating drag on the cable slowing the trolley 11 along the cable 14.

The actuator 56 inserted through the brake pin slot 62 in the frames 16 of the trolley 11 as shown in FIG. 3C facilitates easy actuation of the brake. The positioning of the actuator immediately above the handle 20 is ergonomically appropriate even for small or inexperienced riders. The ability for a rider 24 to grasp the actuator 56 while holding the handle 20 and pull down whenever the rider feels their speed is too great is critical as it allows the rider to hold or release the brake 12 in any desired manner to control their rate of travel, generally descent, along the cable 14.

Figure 4:
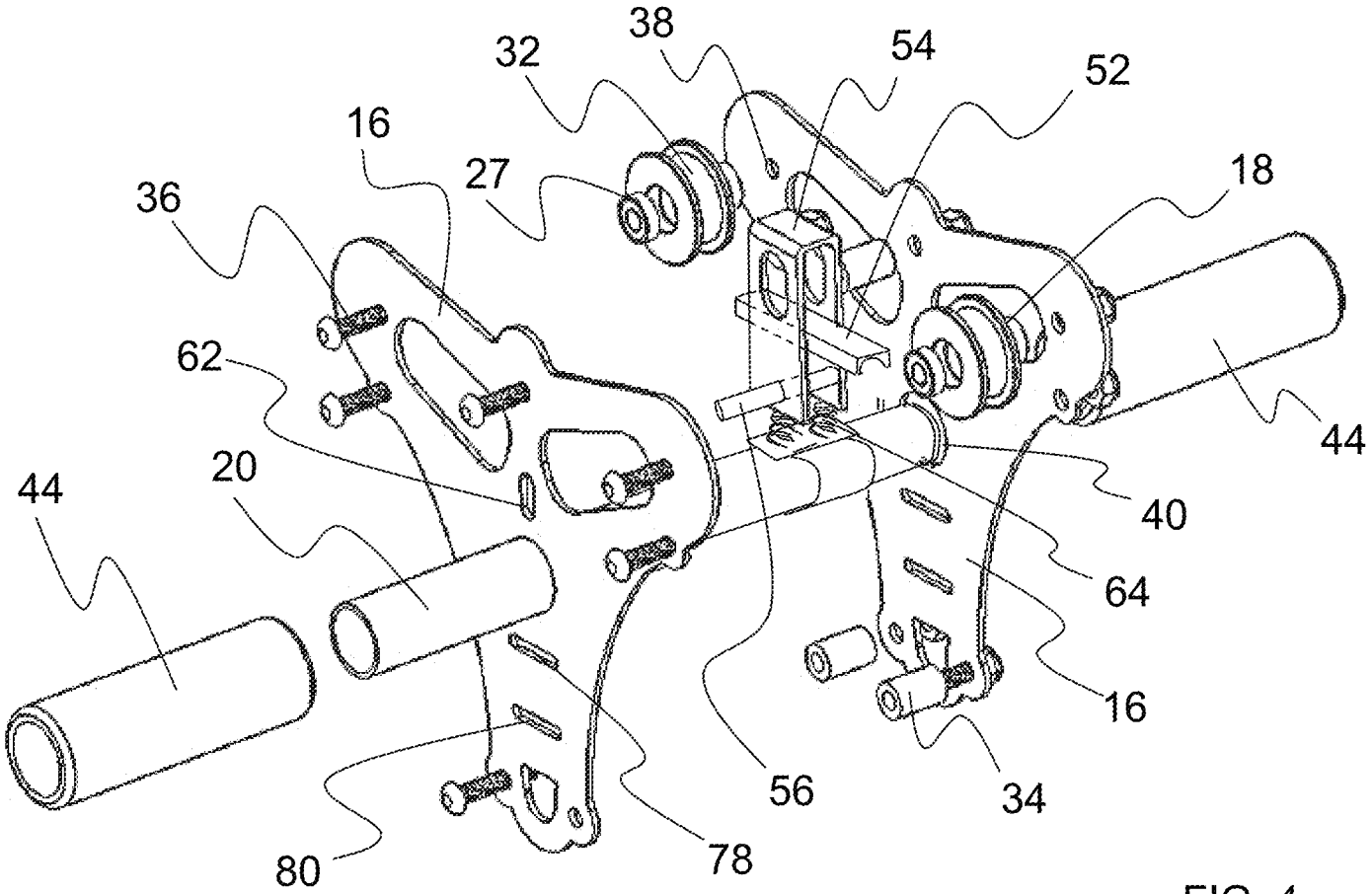
FIG. 4 is an exploded view of a further embodiment of the frame and brake assembly for another embodiment of the zip line system of the present invention.

In an alternative embodiment as shown in FIG. 4 the brake frame 54 is supported in the disengaged position by one or more coil springs 64 influencing the brake frame 54. A spring support 66 may be snapped or clamped on to the handle 20 or otherwise affixed to the frame 16 or brake frame 54. Similar to the previous embodiment, the actuator 56 is inserted through the frame 16 and the brake frame 54 and actuated by pulling down the brake frame 54 and brake pad 52 using the actuator 56 to bring the brake pad 52 into contact with the cable 14.

Different types of springs and biasing devices may be used to bias the brake frame and brake pad 52. In an alternative device, the brake pad 52 may be positioned below or to the side of the cable 14 with the coil springs 64 holding the brake frame 54 and brake pad 52 below and/or away from the cable 14. The rider would then operate the actuator 56 to engage the braking system 12 and slow or stop the descent of the trolley along the zip line system 10.

Figure 5A:
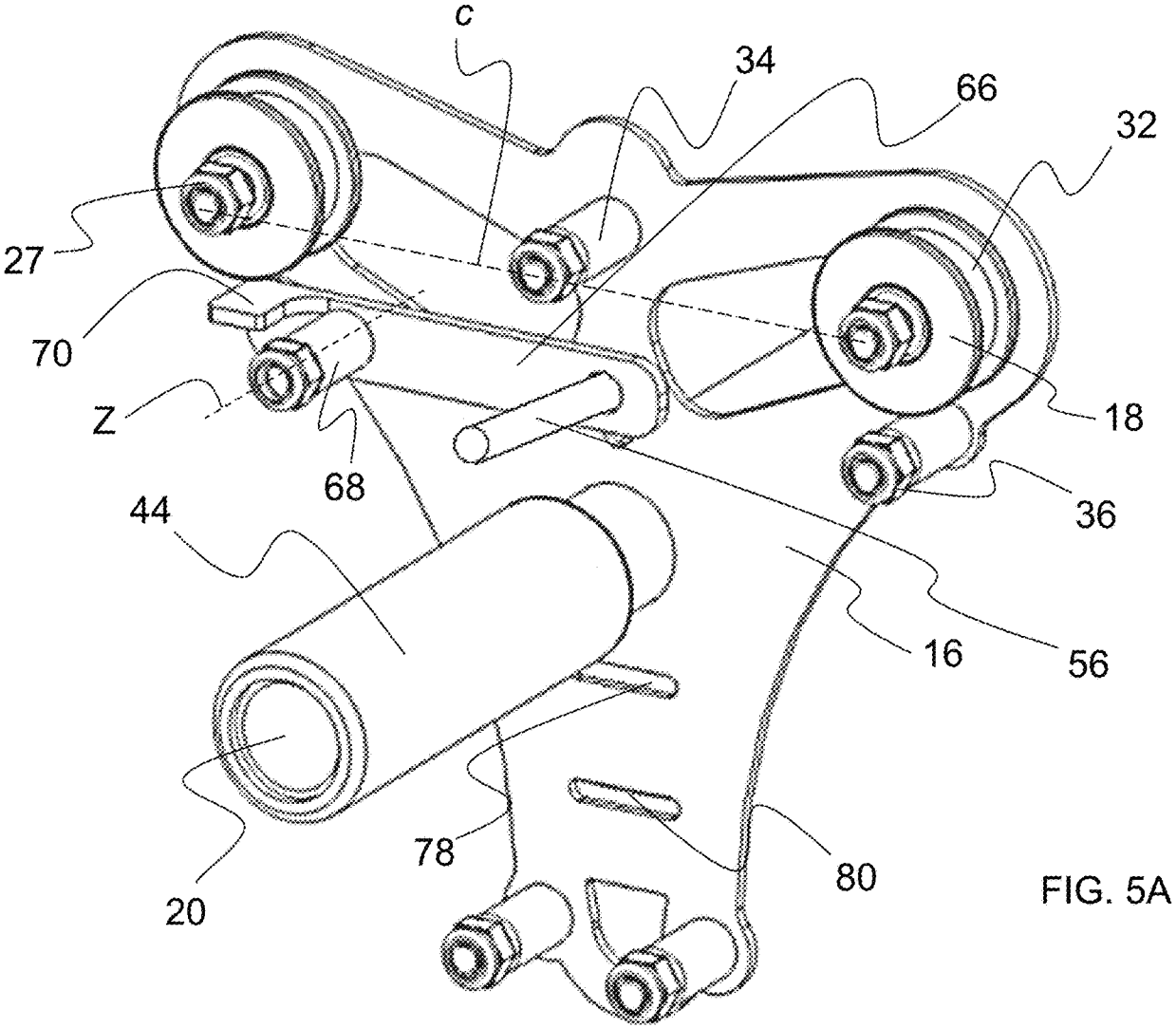
FIG. 5A is a perspective view of a still further embodiment of the frame and brake assembly for another embodiment of the zip line system of the present invention.
Figure 5B:
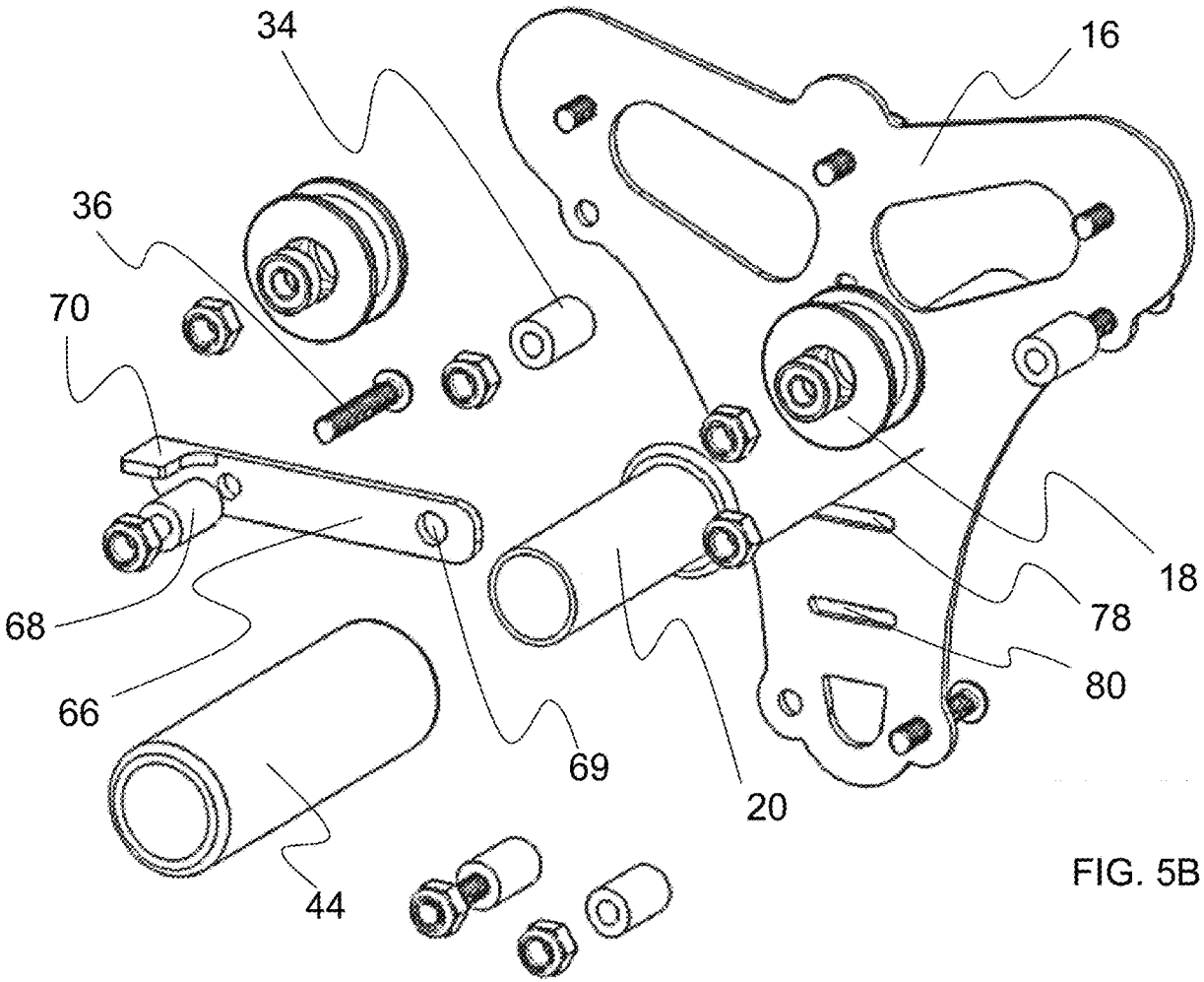
FIG. 5B is an exploded view of the still further embodiment of the frame and brake assembly for another embodiment of the zip line system of the present invention.
Figure 5C:
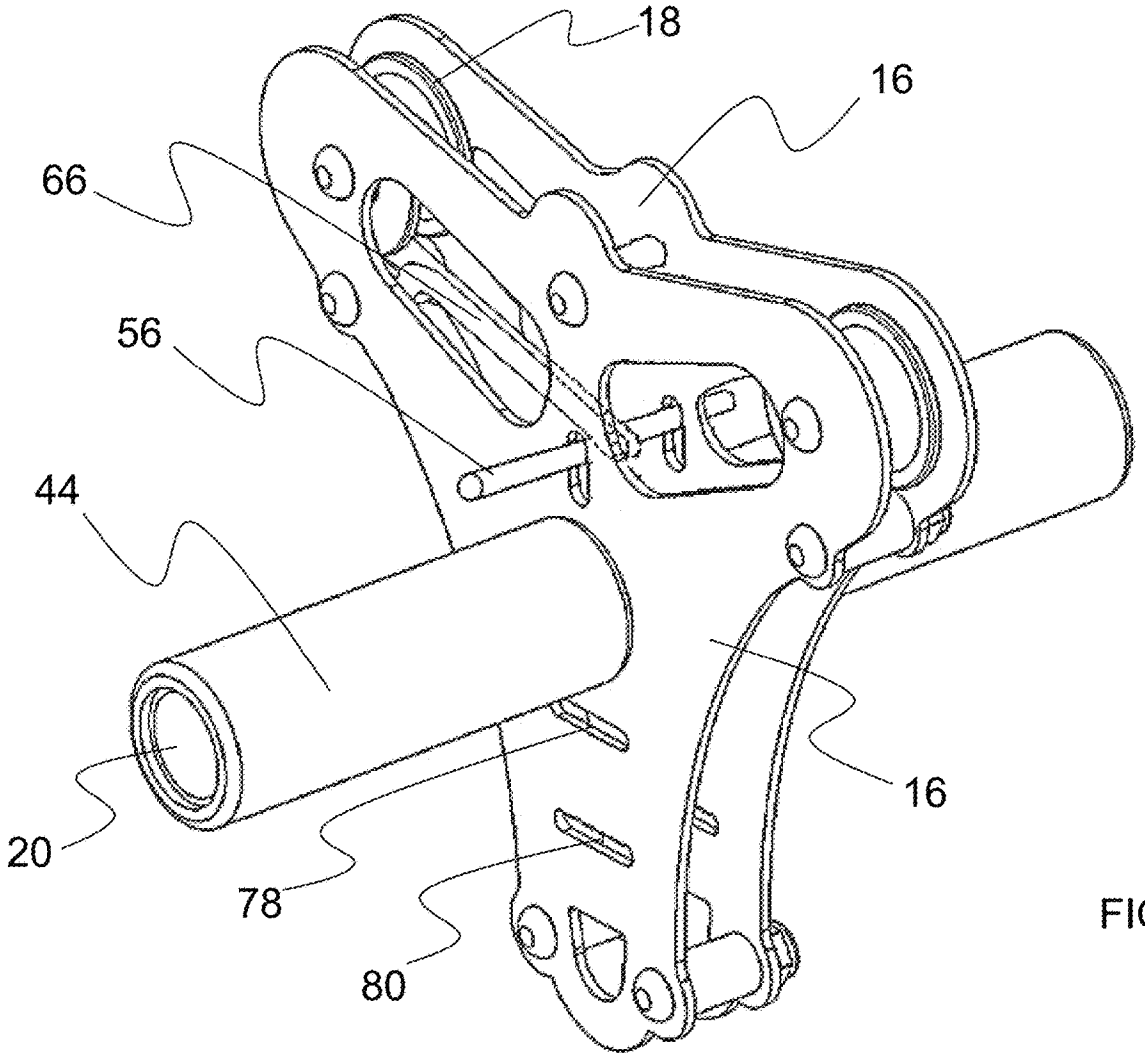
FIG. 5C is a perspective view of the still further embodiment of the zip line system with a second embodiment of the frame and brake assembly.

In a further embodiment, the braking system 12 may be a simple lever pin 66 that is affixed to the actuator 56 and pivots on an axis Z around a lever midpoint, such as the connecting bolt 36 as shown in FIG. 5A. The use of a smaller spacer 68 would allow the lever to be secured within the frame 16, but also provide for an axis of rotation of the lever pin 66 about the bolt 36. The lever pin 66 may have a brake pad 70 that extends along an entire length of the lever 66 from the actuator 56 to the pulley 18 or as shown in FIGS. 5A-5C a smaller surface area that contacts the wire 14 immediately at the pulley to curb rotation of the pulley 18 and slow the descent of the zip line system 10. As shown in FIG. 5B, the actuator 56 is inserted through an opening 69 in the lever pin, allowing the pin to swing down and pivot around the Z axis and force the opposing end of the lever pin 66 having the brake pad 70 to contact the cable 14.

As noted above the lever pin 66 may be positioned below the cable 14 as shown, or alternatively be positioned above the cable 14 by shortening the length of the lever 66 and repositioning the axis point Z perpendicular to a point in the center of the frame 16 near the area of the brake pin slot 62. The actuator 56 and brake pin slot 62 would then be positioned at the opposite end of the lever brake pad 70 and be pulled or pushed up to actuate the braking system 12.

The lever pin brake pad may have a heat resistant lining made of a material with a high coefficient of dynamic friction as described above. In this embodiment with a simple lever, a spring may not be necessary if the brake pad 70 is permitted to merely float or glide along the cable 14 in the disengaged position and operation of the actuator 56 provides a greater frictional force from the brake pad 70 to the cable 14.

The present invention is not intended to be limited to only the braking systems described above. Other braking system structures could also be used to slow the trolley 11, for example a braking system where the brake is generally in an actuated state, i.e. firmly gripping the cable and the actuation of the actuator 56 causes the braking system to essentially release the cable 14. In this way, a rider would actively control their descent by releasing the brake a desired amount, and if their hands came off the trolley 11 and/or released the brake 12, the trolley 11 would immediately slow due to the influence of the brake 12 on the cable 14.

Figure 6B:
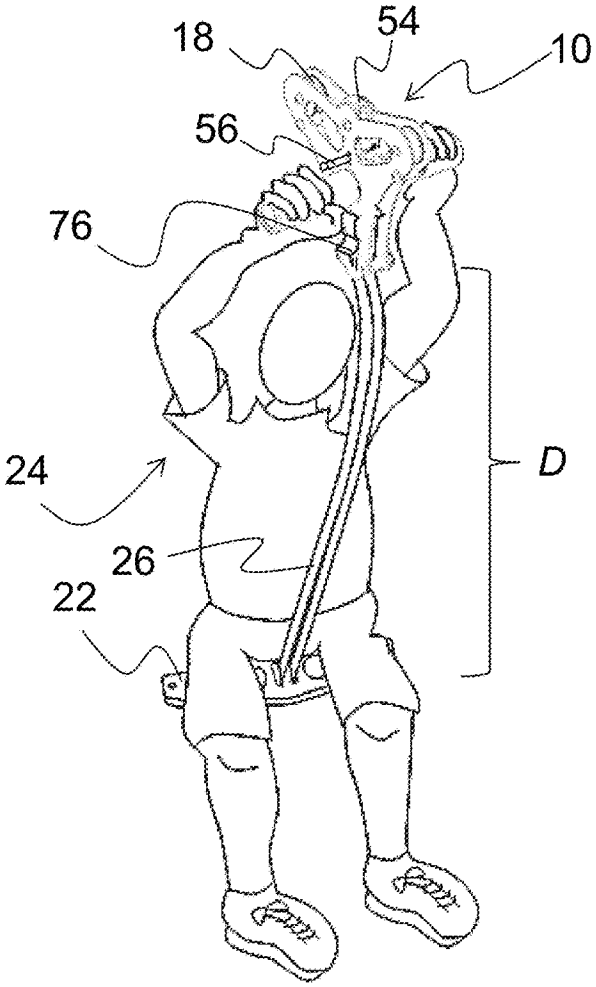
FIG. 6A-6B are perspective views of an embodiment of the adjustable seat for an embodiment of the zip line system of the present invention.
Figure 6A:
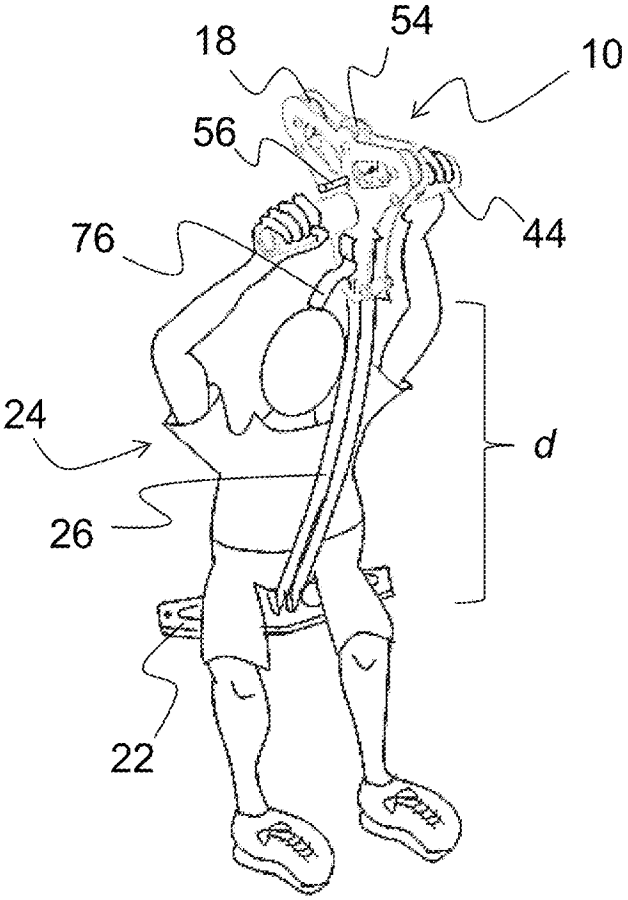

The present invention also provides for alternative methods of attaching the frame assembly 16 to the seat 22 which supports the rider 24. As shown in FIGS. 6A and 6B the frame 16 has a series of adjustment openings for linking and tightening the support webbing 26 to attach the seat or harness to the frame 16. The support webbing 26 is first attached to the seat 22 by looping one or more straps of webbing 26 through one or more slots 47 or openings 50 in the seat or around a seat attachment beam 48. A plastic roller 74 may be affixed to or snapped on to the opening or beam to smooth the surface edge and prevent cutting of the seat 22 into the strap 26. The first end of the webbing 26 may be secured to the seat 22 or alternatively the strap 26 is looped through and around therefore providing two ends of the webbing 26 for attachment to the frame 16.

In a first embodiment, the webbing 26 is inserted through two attachment beams 48 and each webbing end 76 is drawn up to each of the two frame pieces 16, with one end being looped through a first upper slot 78 of a first frame piece 16 and the other end being looped through a first upper slot 78 of the other frame piece 16. Each of the webbing ends 76 for each frame piece 16 are then inserted through a lower slot 80 having teeth to grip the webbing 26 and secure the webbing at a specific length and position. As shown in FIG. 6A, by inserting a longer length of webbing through each slot (78, 80) the distance d from the seat 22 to the frame 16 is shortened for a smaller rider 24 as compared to the distance D in FIG. 6B. For a taller rider 24 with longer arm length, a shorter length of webbing is inserted through the slots (78, 80) leaving a greater distance between the seat and the frame and leaving a shorter length of webbing extending from the toothed slot 80. The webbing 26 may be adjusted to any length that is comfortable for the rider.

Figure 7B:
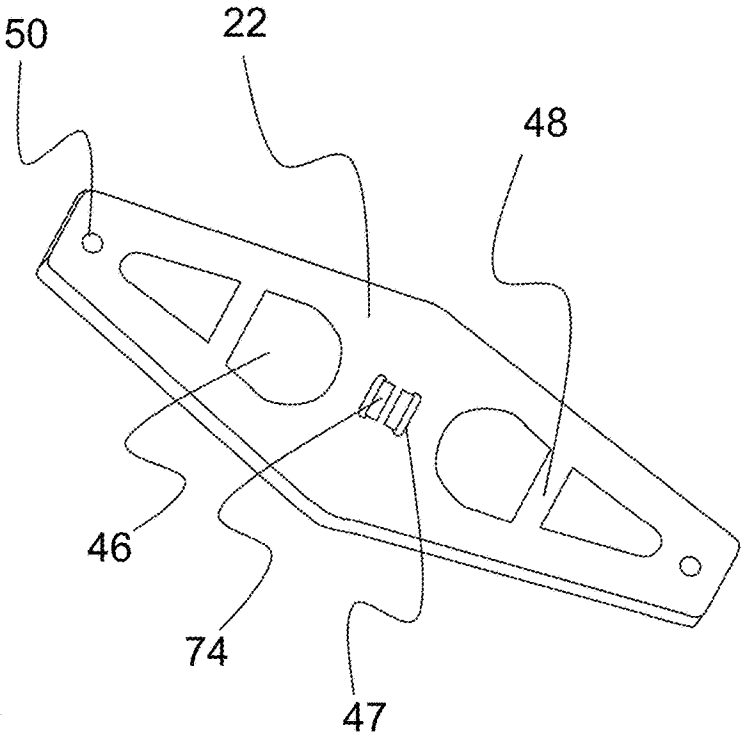
FIG. 7A-7B are perspective views of a further embodiment of the adjustable seat for an embodiment of the zip line system of the present invention.
Figure 7A:
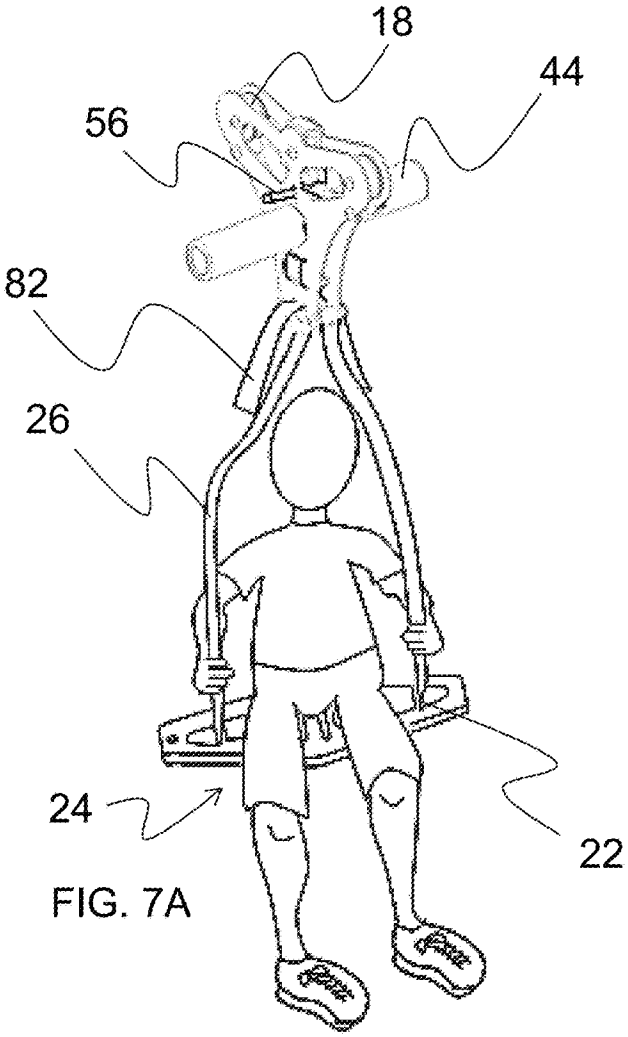
Figure 8:
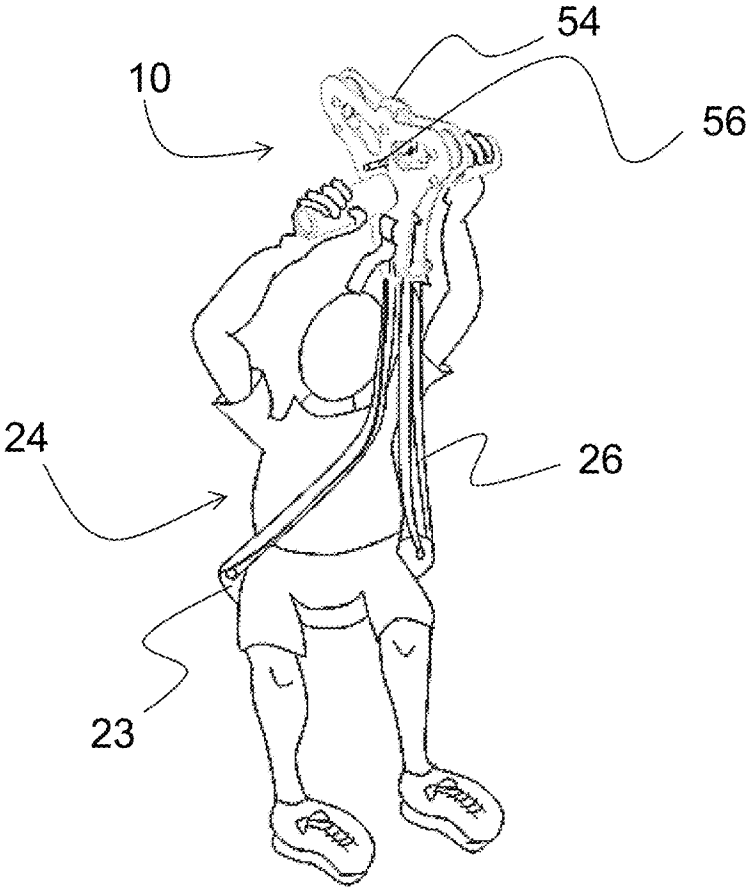
FIG. 8 is a perspective view of an embodiment of the zip line system of the present invention.

In a further embodiment as shown in FIGS. 7A and 7B, one or more straps of webbing 26 may be attached or looped around attachment beams 48 or openings 50 on either end of the extended end of the seat 22 to form a swing to accommodate even smaller riders that may more easily hold onto the straps rather than the over head handle 20. A preferred embodiment of the seat with a number of alternative attachment points using cutouts 46, beams 48 or openings 50 is shown in FIG. 7B, but numerous seat configurations are contemplated to safely support and adjust distances of the frame to the seat for comfort of the rider. In a further embodiment the number of openings 50 may be increased in number and size to provide for a leg and buttocks harness to be attached to the seat 22 to provide additional support and security to the rider. It is to be appreciated that the seat may also be a flexible seat 23, such as a playground swing seat, supported on both ends and which is pliable enough to form around and hug the rider's body when the rider 24 sits in the middle of the seat as shown in FIG. 8. The rider 24 may hold on to the straps or alternatively reach around the straps to hold onto the handle 20, allowing the pliable seat 23 and straps to curve around and safely secure the rider 24.

Figure 9:
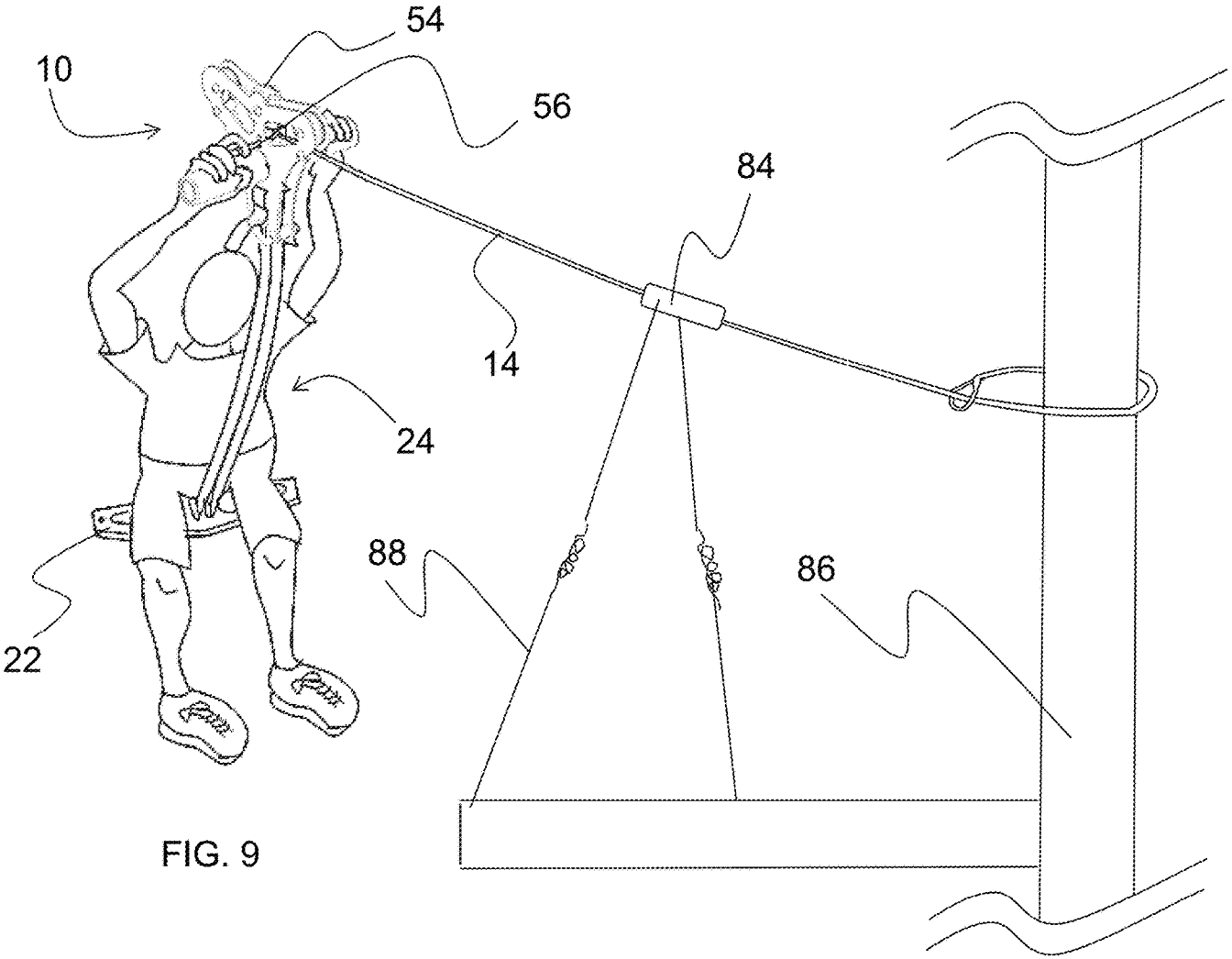
FIG. 9 is a perspective view of an embodiment of the zip line system of the present invention with cable and tower.

Actuation of the braking system 12 as shown in FIG. 9, allows the rider 24 to slow down the zip line system 10, prior to reaching the end of the cable 14. Alternatively to the above described braking systems or in conjunction therewith, the trolley 11 can be stopped at the desired end of descent by a bumper or stopper 84 of a durable polymeric material such as high-density polyethylene (HDPE) or other comparable materials positioned close to the end of the cable 14. The bumper 84 may be supported on the cable 14 and attached to an anchor point or points by shock cords 88, or other type of force absorbing material which permits the bumper 84 and hence the trolley 11 to absorb all or some of the forces developed by the trolley 11 along the zip line and bring the trolley 11 to a safe stop. The braking system 12 provides additional safety and control to the rider to slow their descent and safely reach the ground or tower. The trolley braking system 12 and bumper 84 also provide control to the rider to ease the zip line system 10 to a stop in preference to bumping into the ground or an object and causing injury.

Figure 10A:
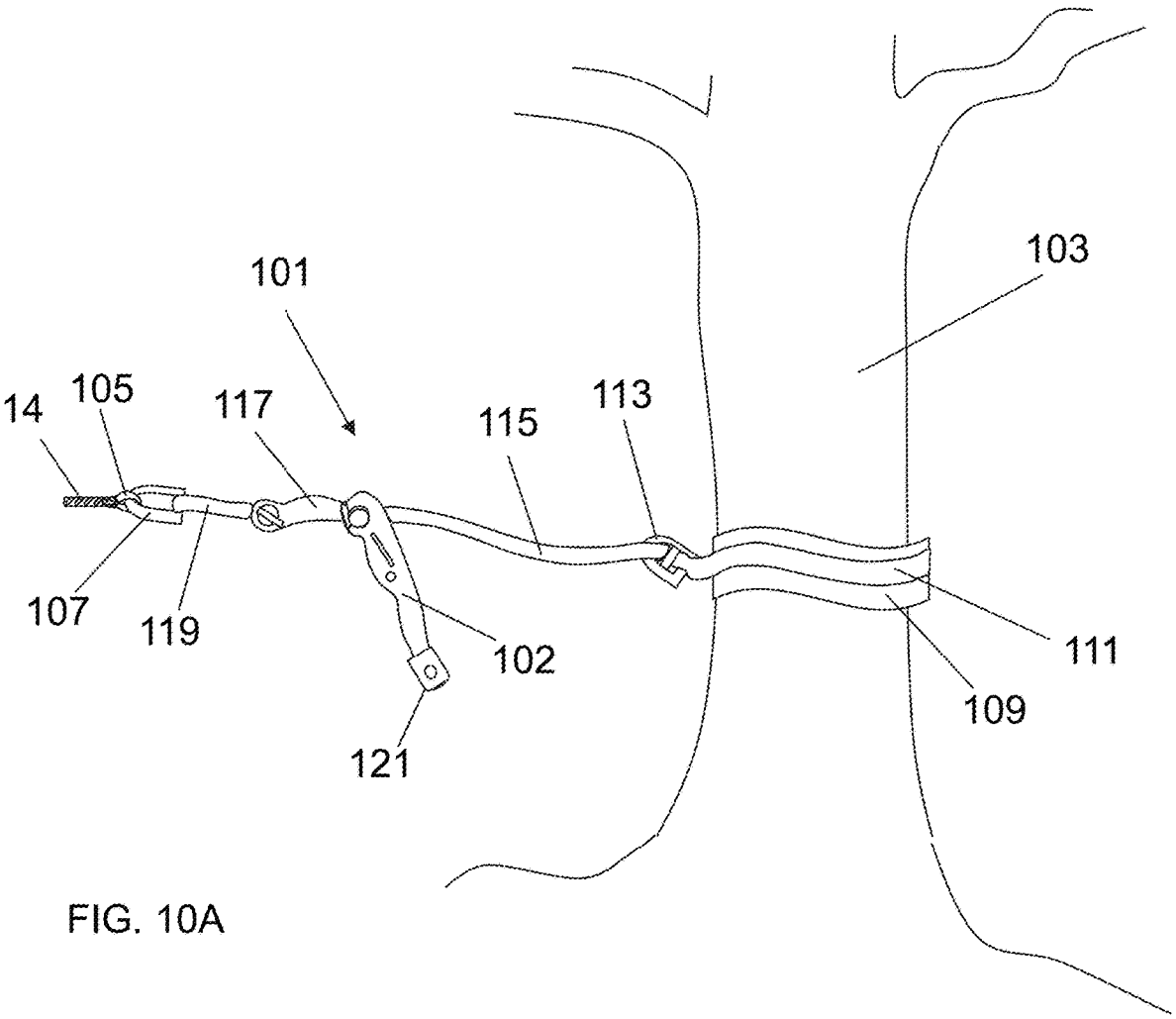
FIG. 10A is a perspective view of a further embodiment of the zip line system of the present invention with a ratcheting harness in an open position for adjusting cable tension.

A support harness 101 that simplifies the installation of the zip line system 10 of the present invention is shown in FIG. 10A. The support harness 101 using a ratchet mechanism 102 allows a user to easily set up the cable 14 of the zip line system 10 in accordance with embodiments of the present invention. The setup of the harness 101 may require no additional tools, and be relatively inexpensive when compared with other cable attachment means. The ratchet 102 may allow a user to adjust the tension in the cable 14 and to easily connect and/or disconnect the cable 14 to or from a support 103. The cable 14 may comprise galvanized aircraft cable or other wire and/or rope having a looped or latch connector 105 at one or more ends for securing the ends of the cable 14 to an attachment fixture, such as D-ring 107 or other metallic support. The support 103 such as a tree, tower or pole must have sufficient strength to support the weight of a user when the user or object that is supported and/or traveling along a zip line system 10 in accordance with the present invention.

Figure 10B:
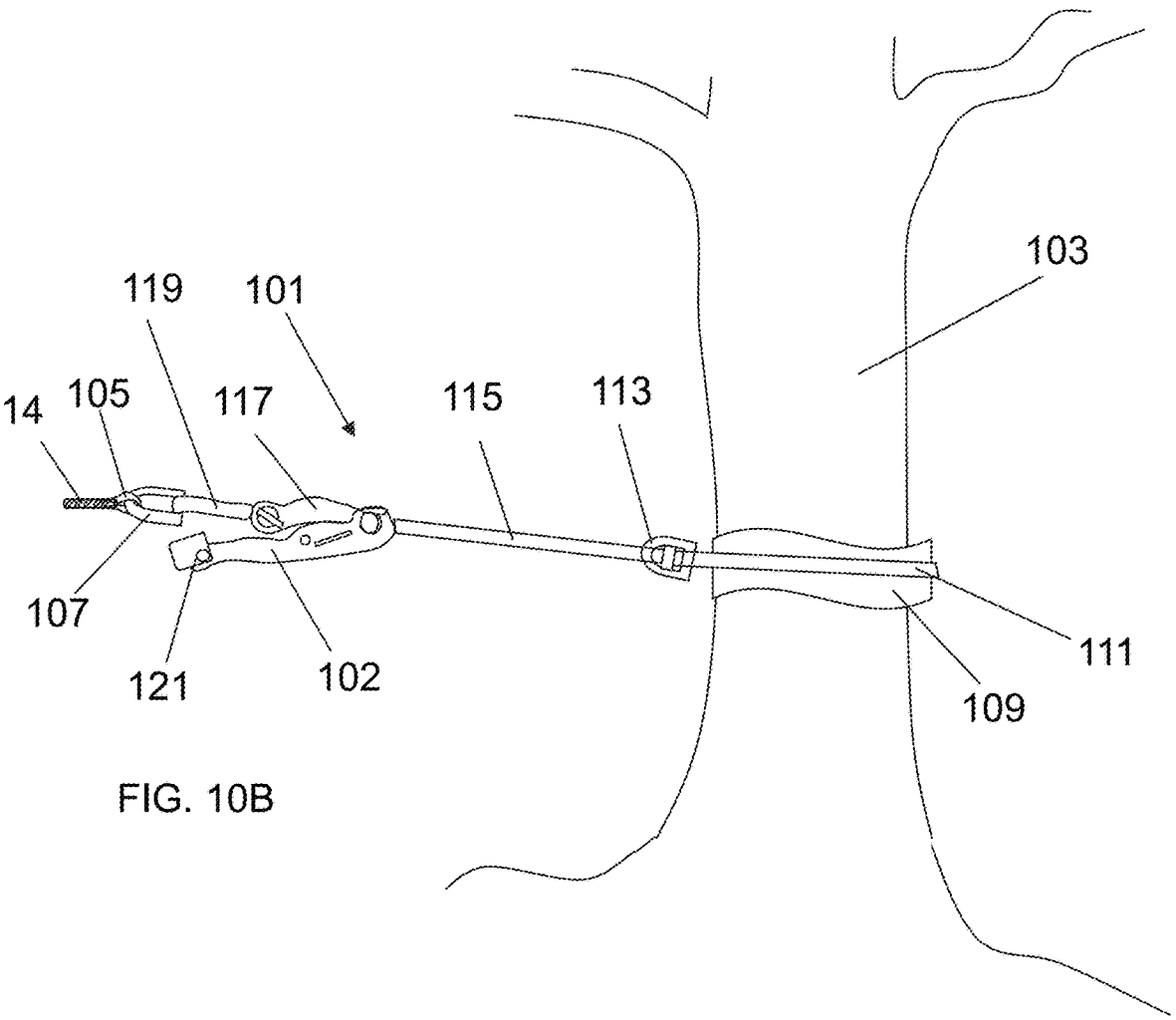
FIG. 10B is a perspective view of the further embodiment of the zip line system of the present invention with a ratcheting harness in a closed position with the cable in tension.
Figure 11A:
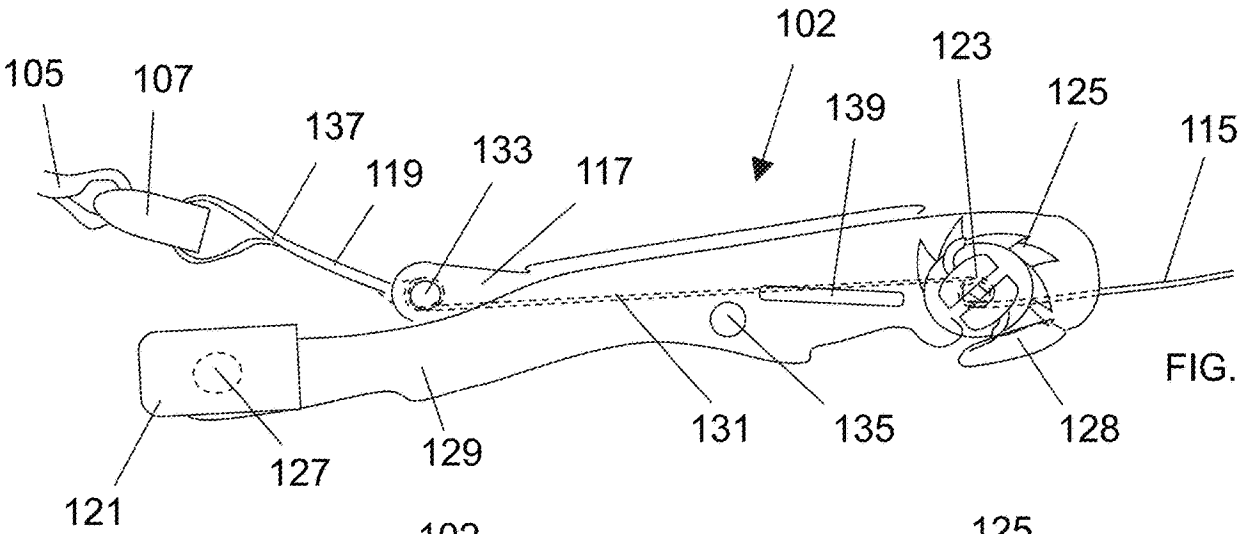
FIG. 11A is a side view of the ratcheting harness in the further embodiment of the zip line system of the present invention.
Figure 11B:
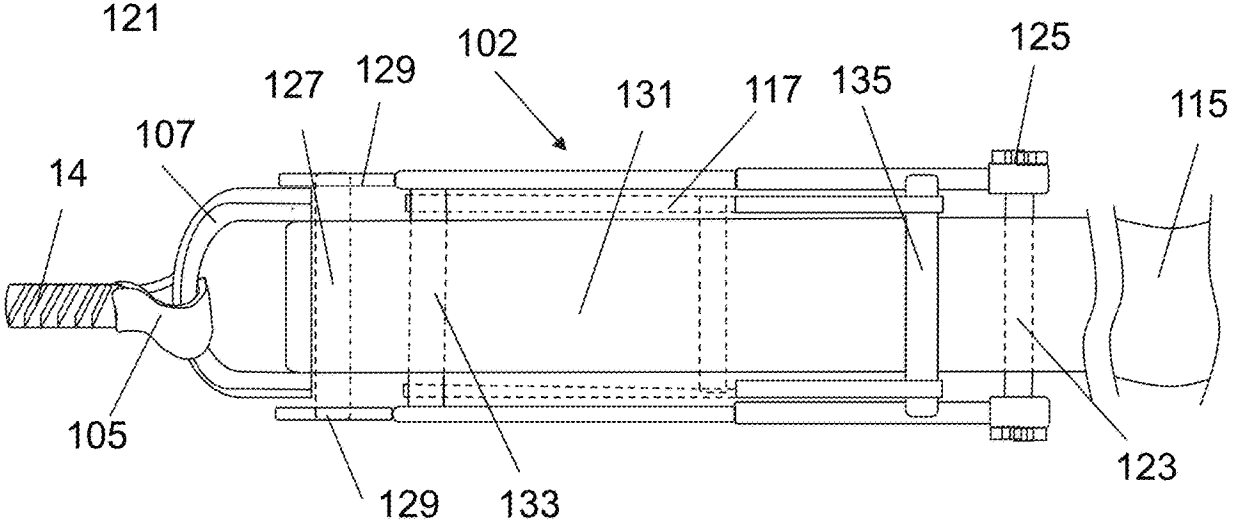
FIG. 11B is a top view of the ratcheting harness in the further embodiment of the zip line system of the present invention.

In an embodiment, the support harness assembly 101 may attach to the support 103 by first installing a protective cover 109 such as a felted pad around for example a tree to protect the tree from damage from the installation of the zip line 10. The cable 14 is secured using a support strap 111 that is installed over the protective cover 109. The support strap 111 may be looped through a buckle or tensioning ring 113. A portion of the strap 115 extends through the tensioning ring 113 and is attached and extends through the bracket 117 of the ratchet 102. An end portion 119 of the cable 111 is drawn through and affixed to the attachment fixture 107 that is attached to the zip line cable 14. A handle 121 provides for pulling and tensioning the support strap 111 to provide adequate tension for the zip line cable 14, as shown in FIG. 10B. The handle 127 is a rod that extends between the handle frames 129 as shown in FIGS. 11A and 11B. By moving the handle 121 back and forth, the teeth 125 of the gear 123 catches on a latch portion 128 of the frame handle 129 and pulls the support strap 111 in only one direction so that each movement further tightens the strap around the tree support 103 and thereby tensioning the zip line cable 14. A portion of the strap 131 is woven through spindles 133 and 135 that extend between the ratchet frames 129. The end of the strap 119 is wrapped around the D-ring 107 or other cable connector and sewn or otherwise securely attached to a lower portion of the strap 137. A release lever 139 provides for loosening the tension to detach or adjust the tension of the zip line cable 14. A safety strap (not shown) may also be attached to D-ring 107 and be similarly secured to the support 103 using a ratchet harness as described herein to support the cable 14 and the weight of the user in the event the support strap 111 fails.

A ratchet support harness assembly 101 may be installed on one end with the other end of the zip line cable 14 looped around a support 103 and through an eye connector (not shown) or other cable connector or mechanical fastener to properly secure the cable to a second support 103. In some embodiments, the opposite end of the cable 14 may be threaded through an eye connector, or the like, and may be clamped using a thimble and cable clips, or the like. Alternatively, both ends of the zip line cable 14 may have a ratchet support harness assembly 101 to adjust the cable to proper tensioning to support the user of the zip line 10 with a safety strap also attached at each end. The cable 14 may be attached to one support 103 at a higher elevation than the attachment of the cable 14 at the other support 103. When the ratchet support harness assembly 101 has been attached to one or both supports 103, the tension in the cable 14 may be adjusted to reduce or increase the slack in the zip line cable 14. The support strap 111 and safety strap may comprise a width adapted to support the weight of a user when supported on the cable 14. For example, the support strap 111 and safety strap may be made from webbing of nylon, polyester, or structurally similar material and may have a width from about ½" to about 6" and in a preferred embodiment a 2" width. In some embodiments, the support strap 111 and safety strap may comprise different widths with the support strap 111 of a greater width than the safety strap. The ease of installation and flexibility of the support harness 101 provides for an embodiment of the zip line system 100 to be portable, where one or more support harness assemblies 101 can attach the cable quickly and easily to a tree, tower or other support without the need for heavy tools, fasteners, or disassembly of the trolley. The removable seat as described below further provides for the handle to be easily removed from the trolley and stored for easy carrying.

Figure 12:
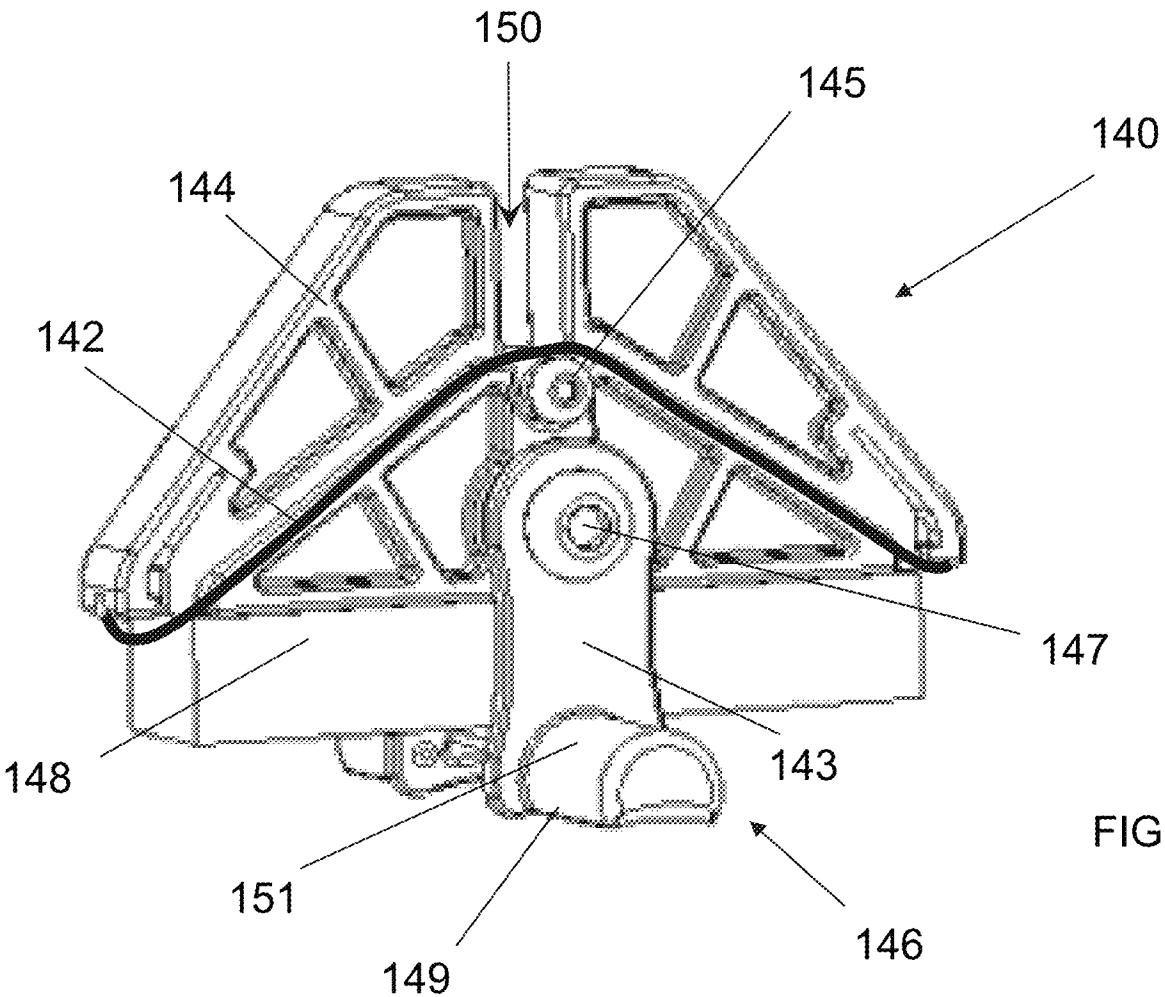
FIG. 12 is a perspective view of an embodiment of the braking support and brake pad with lever actuator and elastic of the braking system in an embodiment of the zip line system of the present invention.

In further embodiments, the braking system 140 of the zip line system 100 may retain the brake pad 148 to float above the cable 14 via an elastic member 142 that may be attached to each end of the brake pad 148 and be suspended from the center connecting pin 145 as shown in FIG. 12. The braking system 140 may comprise the elastic member 142, a distributive structural support frame 144, a braking lever 146 for actuating the braking system 140, and the brake pad 148. The elastic member 142 is suspended from the connecting pin 145 that is affixed to the trolley assembly 210 and inserted within a slot 150. As the braking lever 146 is pulled to contact the brake pad 148 with the cable 14, the connecting pin 145 moves along the slot 150. The braking lever 146 is attached to the braking system 140 using a bolt 147 or other attachment means. The braking lever 146 has a bracket 143 that supports a handle 149. The handle 149 has a rounded surface 151 for a user to place one or more fingers on and pull down to actuate the braking system 140.

Figures 13A, 13B:
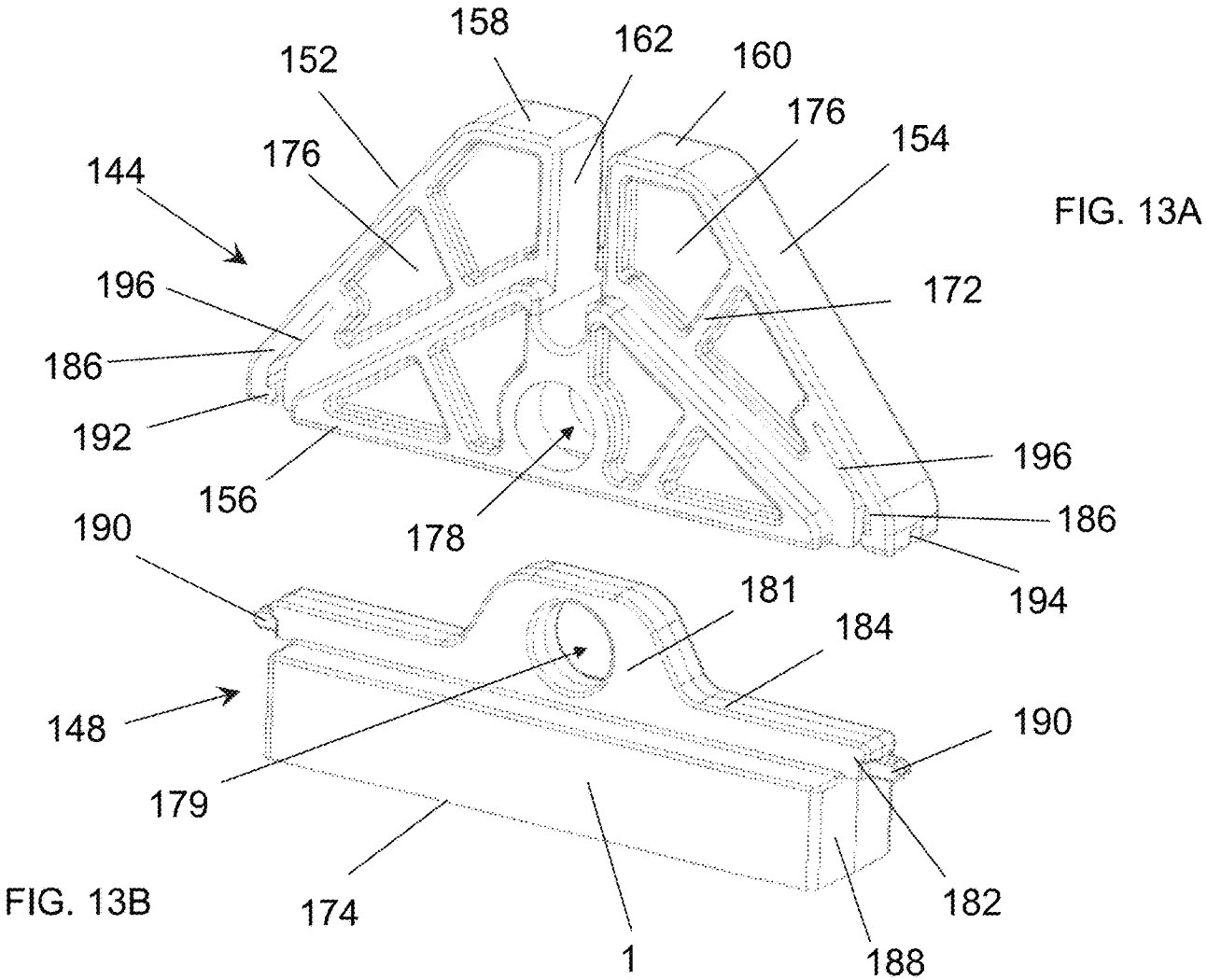
FIG. 13A is a side perspective view of an embodiment of a braking support in a further embodiment of a braking system in an embodiment of the zip line system of the present invention.
FIG. 13B is a side perspective view of an embodiment of a brake pad in a further embodiment of a braking system in an embodiment of the zip line system of the present invention.

In an embodiment of the braking system 140, the braking support frame 144 as shown in FIG. 13A may be triangular or trapezoidal in shape with opposing angular frame members 152 and 154 that extend from a base 156 to an upper member. The upper member in one embodiment may be first and second lateral frame extensions 158 and 160 that extend to interior wall members 162 and 164 that form the brake pin slot 150 for the connecting pin 145. Alternatively, the slot 150 may be formed through the support frame 144. A series of struts 172 may extend between the frame members to distribute forces in tension and compression through the structural support frame 144 and thereby transfer forces evenly along brake pad 148. In this manner, a minimal force by the user is distributed along the cable engaging surface 174 to smoothly slow the zip line system 100 down. The distributed forces further reduce wearing of the brake pad 148 because nearly the entire cable engaging surface 174 of the pad is in continuous engagement with the cable 14 when the brake is actuated. The mid-portions 176 between the struts 172 and frame members may be openings that extend through the support frame 144 or alternatively be areas of lesser material to provide the structural support 144 and reduce costs and weight.

Figures 14A, 14B:
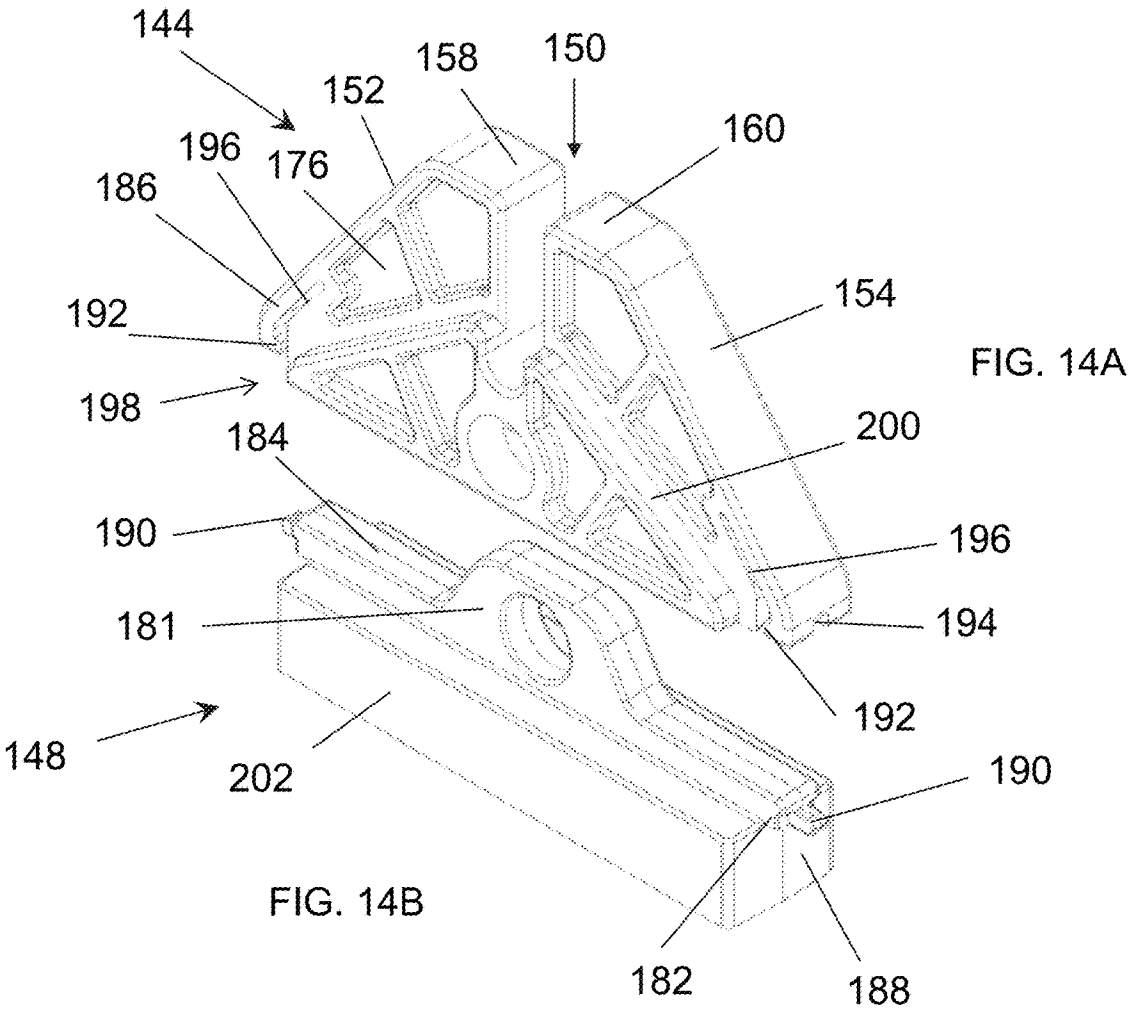
FIG. 14A is a top perspective view of an embodiment of the braking support in a further embodiment of a braking system in an embodiment of the zip line system of the present invention.
FIG. 14B is a top perspective view of an embodiment of the brake pad in a further embodiment of a braking system in an embodiment of the zip line system of the present invention.

A mounting hole 178 may be formed through the support frame 144 with a second mounting hole 179 formed through the brake pad holder 184. The brake pad mounting hole 179 may be formed through a handgrip 181 in the holder 184. The brake pad 148 may be removably affixed to the brake pad holder 184 and the holder 184 may be removably affixed to the braking system support frame 144. In an embodiment, the ends 182 of the brake pad holder 184 may extend the brake pad 148. The ends 182 may then snap into clips 186 formed on either end of the support frame 144 as shown in FIGS. 14A and 14B. The ends 182 that extend beyond the end 188 of the brake pad 148 may have tabs 190 that provide for attachment of the elastic member 142. A ledge or shelf 192 is formed at the base of the clip 186 with a channel 194 for the tab 190 to extend beyond the frame members 152 and 154 of the braking system support frame 144. By separating the clip 186 from an inner surface 196 of the support frame 144, the end 182 of the brake pad holder 184 can be snapped into and be secured to the support frame 144 and once snapped in may be snapped out to remove and replace the brake pad 148.

Figures 15A, 15B:
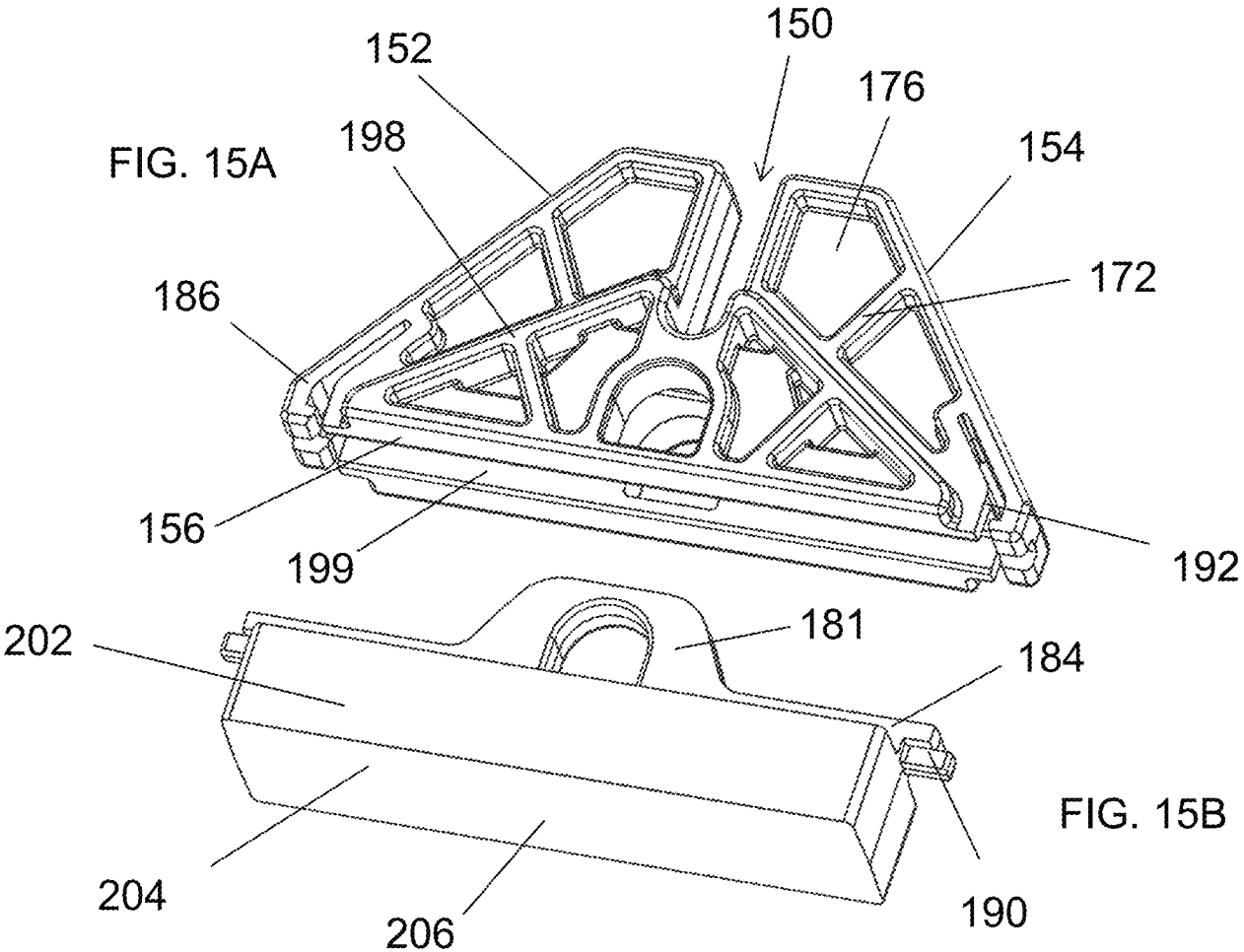
FIG. 15A is a bottom perspective view of an embodiment of the braking support in a further embodiment of a braking system in an embodiment of the zip line system of the present invention.
FIG. 15B is a bottom perspective view of an embodiment of the brake pad in a further embodiment of a braking system in an embodiment of the zip line system of the present invention.

The braking support frame 144 may further include a guide 198 as shown in FIG. 14A that provides a surface 200 to align the elastic member 142 over and around the braking support frame 144. The guide 198 may extend from each side of the support frame 144 and be formed as a triangle, trapezoid or in another shape to create support surfaces 200 for the elastic member 142 along the side of the braking support 144. In some embodiments, the entire braking structural support frame 144 may be formed as a single piece with the guide 198 from a lightweight, strong, rigid material such as aluminum or preferably from a plastic such as nylon 6-6 polyamide using a molding or extrusion process. Alternatively, the guide 198 may be a separate piece that is snapped onto or otherwise affixed to the support frame 144. At the base 156 of the support frame 144 and guide 198 a slot 199 is formed, as shown in FIG. 15A. The slot 199 provides for the handgrip 181 of the brake pad holder 184 to be inserted into the support frame 144 to align the mounting holes 178 and 179 for mounting the braking system 140 to the trolley assembly 210.

Figures 15C, 15D:
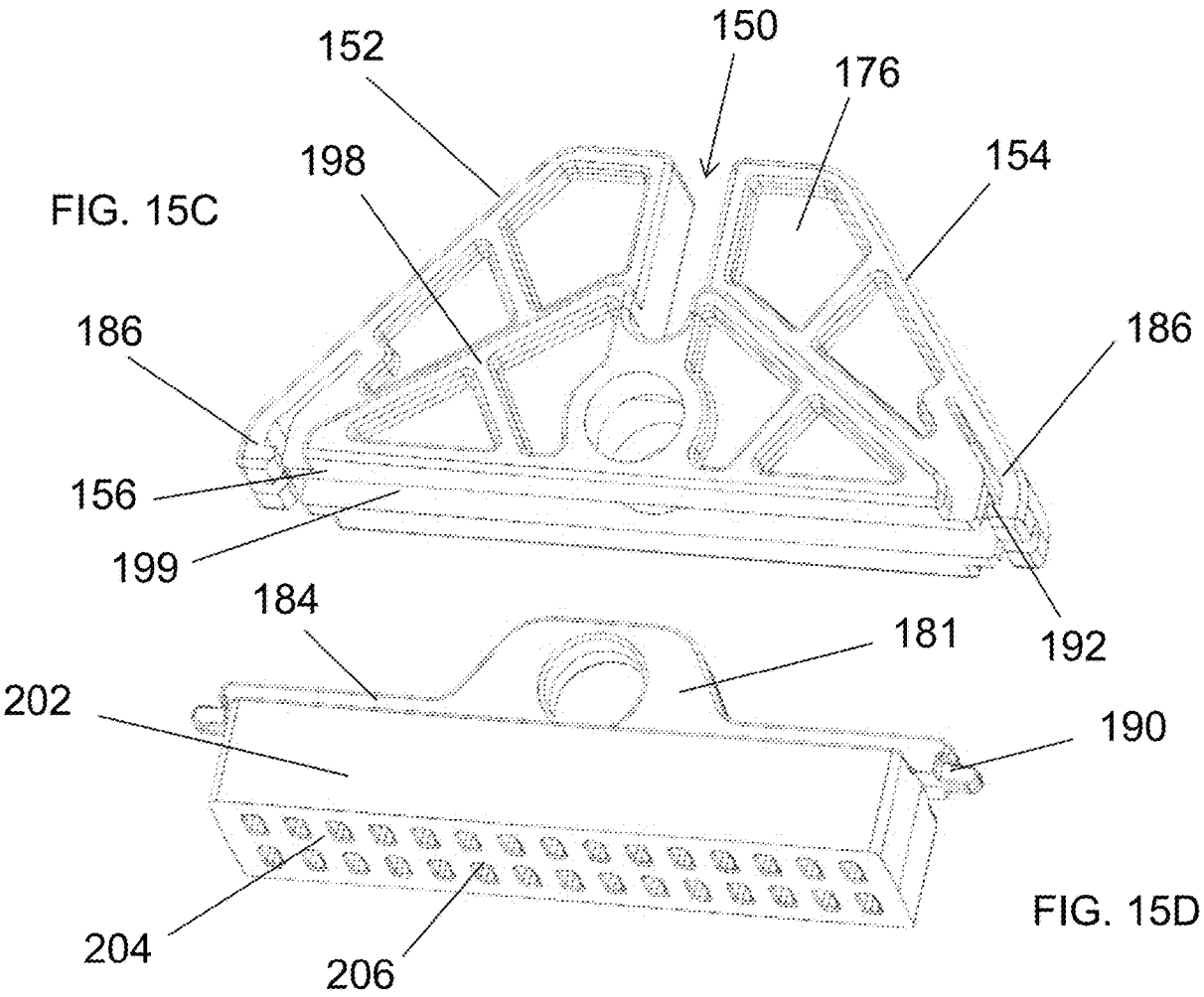
FIG. 15C is a bottom perspective view of an embodiment of the braking support in a further embodiment of a braking system in an embodiment of the zip line system of the present invention.
FIG. 15D is a bottom perspective view of a further embodiment of the brake pad having perforated openings in a further embodiment of a braking system in an embodiment of the zip line system of the present invention.

As shown in FIG. 15B, the frictional component 202 of the brake pad 148 and the brake pad holder 184 may be formed as a single piece from a polyurethane or other heat resistant thermosetting plastic. Alternatively, the frictional component 202 may be a separate piece that is affixed to the brake pad holder 184 so that it can be removed and replaced as the brake pad component 202 wears down from contact with the zip line cable 14. In a further embodiment, the frictional component 202 may be formed from a thermosoftening plastic that may become pliable above a certain temperature and then return to a solid state upon cooling. A further embodiment of the frictional component 202 is shown in FIG. 15D. The lower surface 204 of the frictional component 202 has a series of openings or perforations 206 aligned through the surface. The perforations 206 provide for the thermosoftening material of the frictional component to soften or melt as the pad is heated while being dragged along the zip line cable 14 and then reform and reset as the pad is cooled, reducing overall wear and extending the life of the brake pad 148.

Figure 16:
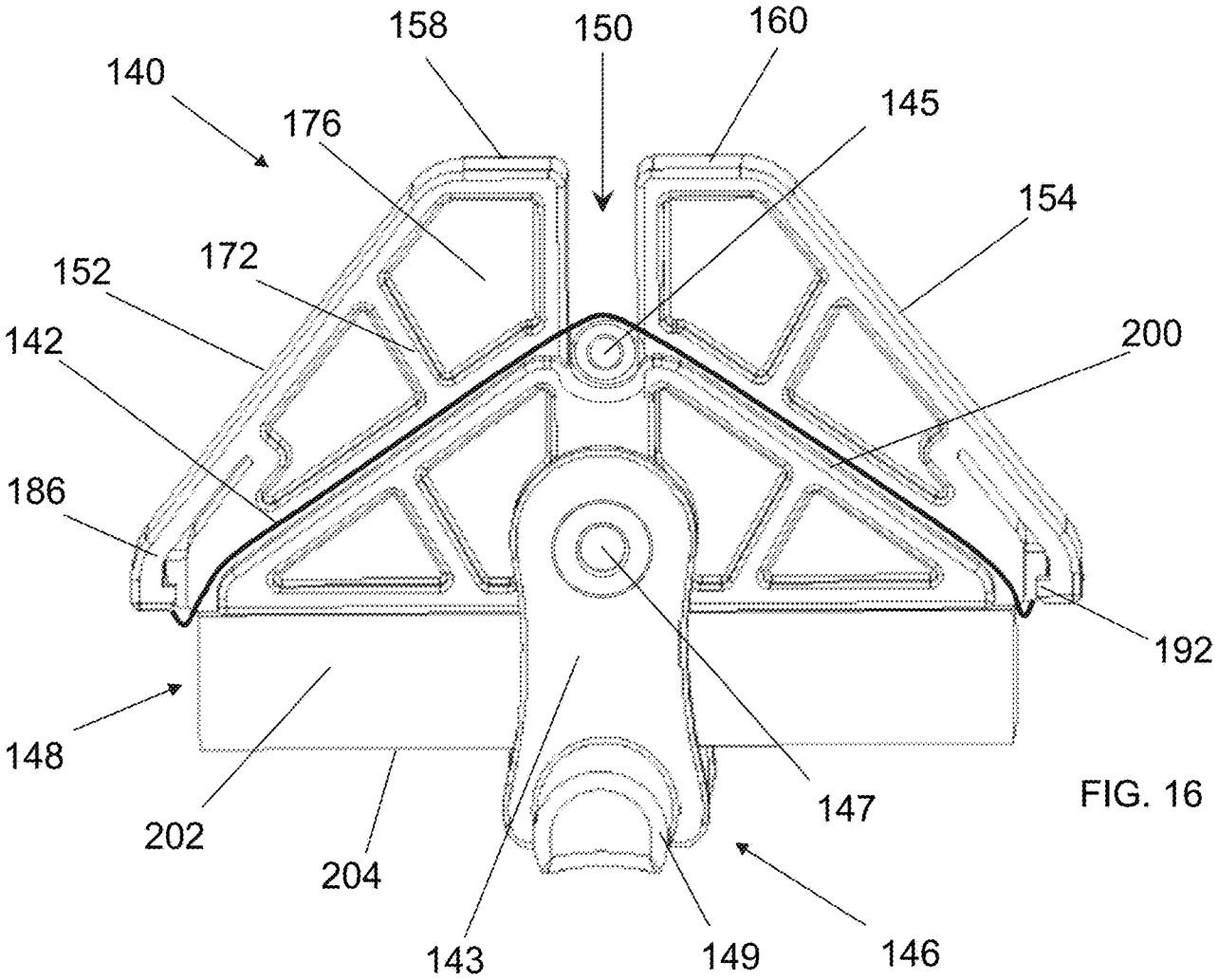
FIG. 16 is a side view of an embodiment of the braking support and brake pad with lever actuator of the braking system in an embodiment of the zip line system of the present invention.

The braking system 140 is shown in FIG. 16 with the braking lever 146 but without installation of the braking system 140 to the trolley assembly 210. In installing the braking system 140, the connecting bolt 147 extends through the bracket 143 of the lever 146, through a slot 208 in a further embodiment of a first frame piece 211, shown in FIG. 17, through the mounting hole 178 in the structural braking support frame 144, through the mounting hole 179 in the brake pad 148 and through a slot 208 in a second frame piece 212 shown in FIG. 18 and through a second bracket 143 to attach the levers 146 to either side of the further embodiment of the zip line system 100. The connecting bolt 147 is secured using a nut 214 or other attachment fixture. The connecting pin 145 extends through an opening 216 in the frame 210, through the braking system slot 150 and through the second frame piece 212 to remain stationary and suspend the elastic member 142. The elastic member 142 rides along the surface 200 of the braking support 144 to reduce wear and prevent stress points in the elastic member 142 as a user pulls down on the levers 146 to have the braking system 140 contact the cable 14 to reduce the speed and slow the zip line system 100 down.

Figure 17:
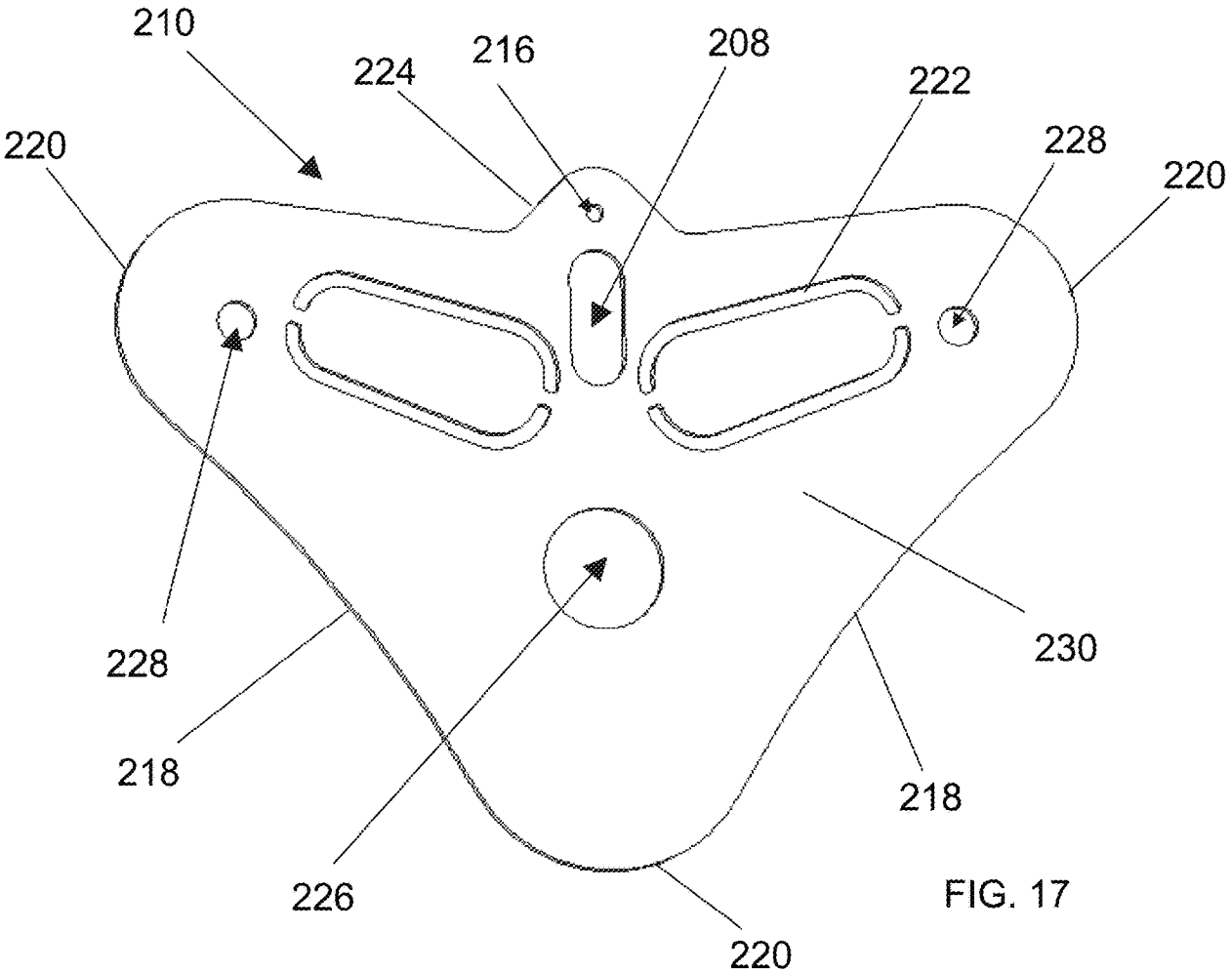
FIG. 17 is a side view of the frame of the trolley assembly in an embodiment of the zip line system of the present invention.
Figure 18:
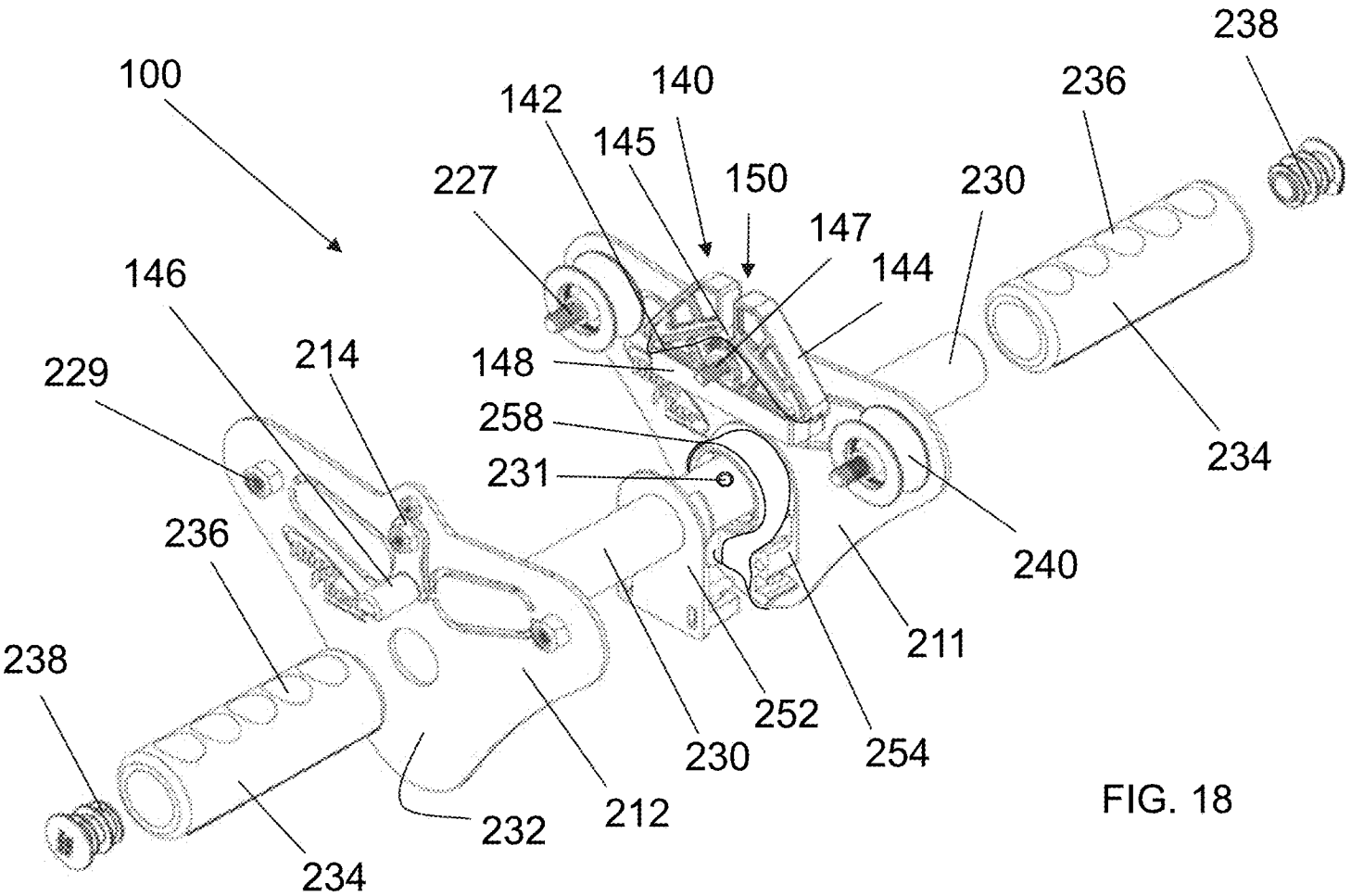
FIG. 18 is a side perspective view of the further embodiment of the braking system and a further embodiment of a handle and seat clamp in an embodiment of the zip line system of the present invention.

In an embodiment, the frame piece as shown in FIG. 17 are of a smaller size and weight with smooth contours along each edge 218 and a more triangular shape with rounded corners 220 and decorative cutouts 222 that may be of any shape to uniquely stylize the zip line system 100. A triangular extension 224 in the upper center of the frame piece 210 provides a minimal amount of surface area for the opening 216 for the connecting pin 145 that supports the elastic 142. In a lower center portion of the frame piece 210, an opening 226 is provided for a handle 230 as shown in FIG. 18 that similar to previous embodiments is inserted through the opening 226 and secured on each exterior side 232 of the frame pieces 211 and 212 using cushioned grips 234 that are tightly slid around each end of the handle 230. The handle 230 may have a releasable attachment mechanism such as a detent 231 in the form of a ball or pin affixed to a leaf spring that extends through an opening in the handle 230. As the handle 230 is slid through openings in the trolley frame pieces 211 and 212 and the removable seat holder fixture 250, the detent 231 can be compressed to slide the handle 230 through the trolley assembly 210. The detent 231 when extended may latch the handle 230 to the removable seat fixture 250 as described herein.

The handle 230 may be a rigid, hollow bar of aluminum or another lightweight metal to further reduce the overall weight of the zip line system 100. The grips 234 may have ergonomic contours 236 that provide finger rests for the user of the zip line system 100. Stoppers 238 are frictionally fit into the hollow ends of the handle 230 form a tight seal to further secure the grips 234 to the handle 230. Additional openings 228 in the upper left and right portions of the frame pieces 211 and 212 are provided for bolts 227 to secure the pulleys or wheels 240 to the frame pieces 211 and 212. A nut 229 or other attachment fixture is connected to the bolt 227 to connect the wheels 240 and two frame pieces 211 and 212 together to form the trolley assembly 210. In an embodiment, the wheels 240 have lubricant free internal bearings that maximize the speed of descent and require limited or no maintenance.

The smaller size of the frame pieces 211 and 212 of the trolley assembly 210, ease of installation and flexibility of the support harness 101, and the unique removable seat fixture 250 shown in the exploded view of FIG. 18 as front and back snap fit pieces 252 and 254 provide for the zip line system 100 to be completely portable. Storage of the system 100 in a back pack or bag allows a hiker or camper to trek into the wilderness, find appropriate trees to install the zip line system 100 and be quickly and easily traversing the terrain from above. The seat fixture 250 with the seat 260 shown in an embodiment in FIG. 19 as an oval or elliptical shaped seat 261 and as a round disk seat 263 in FIG. 20. By removing the handle 230, the seat fixture 250 slides out of the base of the trolley assembly 210 providing an additional level of safety where the seat can be removed and the trolley assembly 210 can be pulled up and off of the cable 14 in order to transport the zip line system 100 or so that a small child does not attempt to use the system 100 when unattended.

Figure 20:
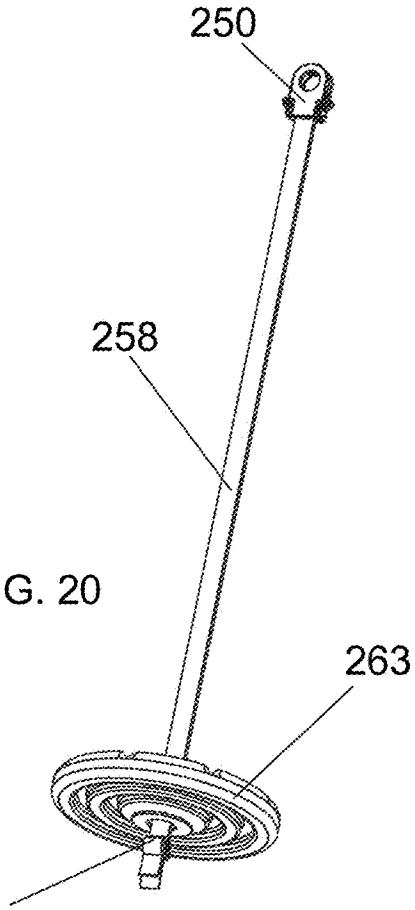
FIG. 20 is a perspective view of a further embodiment of the seat affixed to the removable seat fixture.
Figure 19:
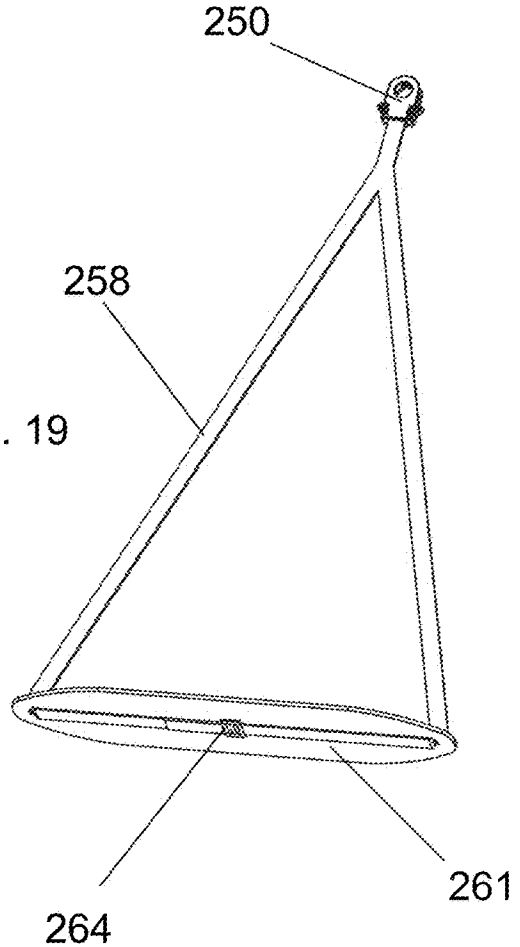
FIG. 19 is a perspective view of an embodiment of the seat affixed to the removable seat fixture.
Figure 21:
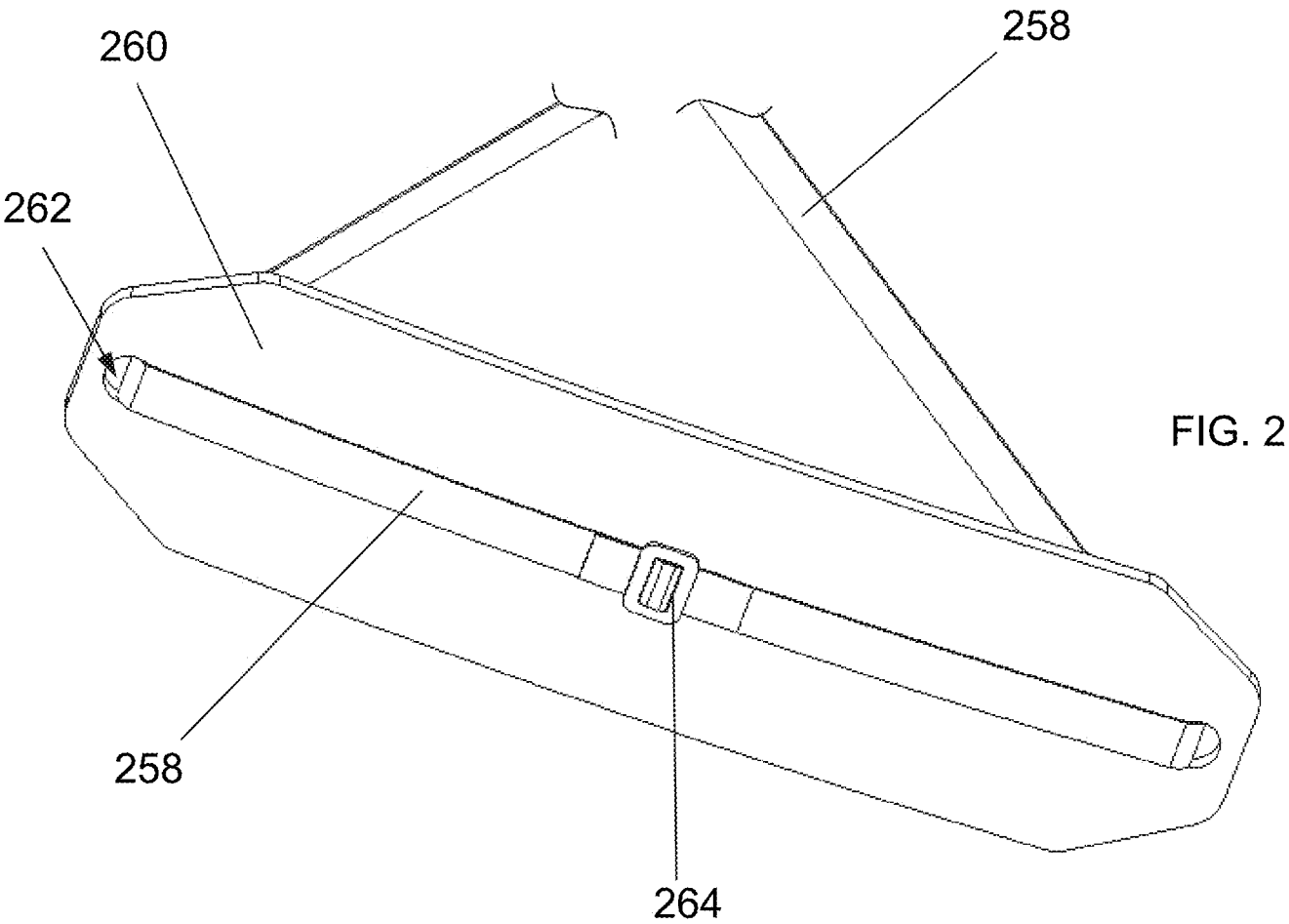
FIG. 21 is a perspective view of an embodiment of the attachment for the seat.

The seat 260 is secured to the removable seat fixture 250 using webbing 258 that loops around a donut shaped surface 266 of the removable seat fixture 250 and is clamped between the front and back snap fit pieces 252 and 254. The webbing 258 then extends in between the frame pieces 210 and 212 and through openings in the seat 260. The seat 260 as described may be of aluminum, another metal or of a plastic composite with an ergonomic shape to allow for a rider to sit comfortably. In a further embodiment seat 260 may be a strong flexible material such as a rubber based plastic that may be folded and stowed for portability of the zip like system 100. The webbing 258 is secured by being inserted through a hole in the seat 263 and be tied into a knot 265 at the bottom of the seat 263 as shown in FIG. 20 or using in one embodiment a snap buckle 264 that may have teeth along an edge that holds the webbing 258 in place so that once secured it is difficult to remove the webbing 258 from the buckle 264 as shown in FIGS. 19 and 21. The length of the webbing 258 may be adjusted by pulling more or less webbing through the buckle 264 or in tying the knot 265 below the seat 260.

Figure 23:
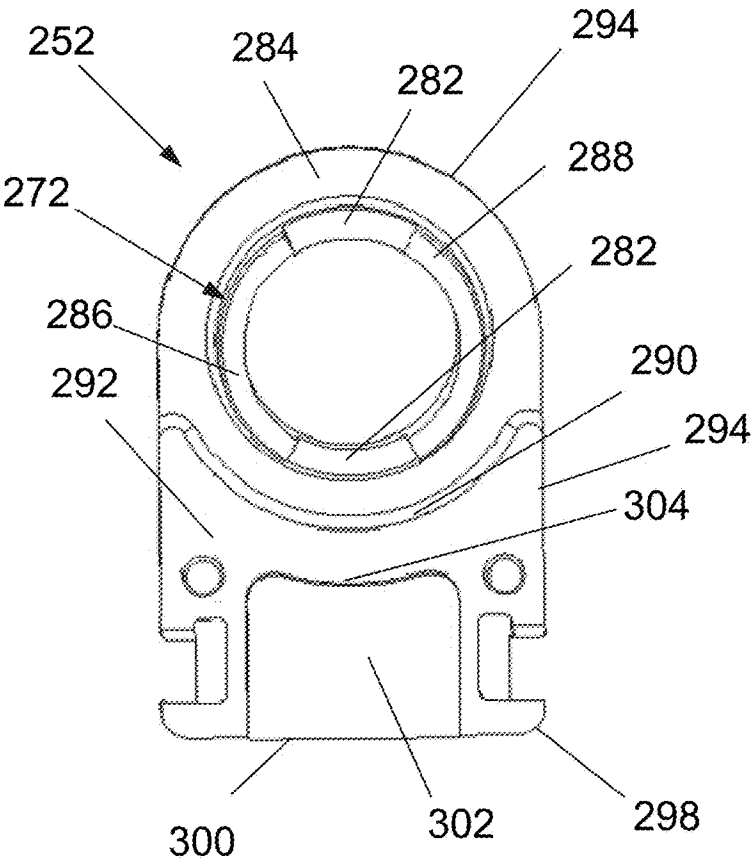
FIG. 23 is a perspective view of an embodiment of the back snap fit piece of the removable seat fixture.
Figure 22:
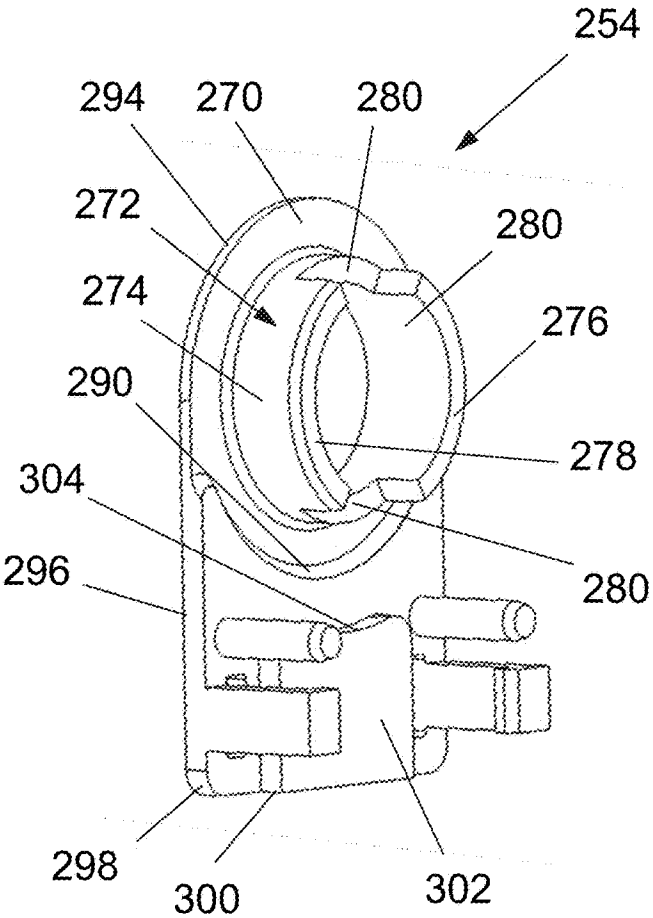
FIG. 22 is a perspective view of an embodiment of the front snap fit piece of the removable seat fixture.

The removable seat fixture 250 is comprised of the back snap fit piece 254, as shown in FIG. 22 and the front snap fit piece 252, as shown in FIG. 23. The back snap fit piece 254 has a base 270 that supports a circular extension or donut 272. The donut 272 has a smooth circular outer surface 274 along the entire circumference with upper and lower cutouts 280 that separate semi-circular walls 276 and 278. The cutouts 280 complement the semi-circular extensions 282 of the front snap fit piece 252 that extend further from the base 284 than opposing semi-circular wall portions 286 and 288. The cutouts 280 and extensions 282 interlock to align the front and back snap fit pieces 252 and 254 to provide a partially continuous circular outer surface for the seat webbing 258. The circular outer surface may have a gap that provides for the releasable detent 231 of the handle 230 to be interlocked within the gap to lock the handle to the trolley assembly 210 preventing the handle 230 from slipping or being pulled out without a requirement that additional force be used to compress the detent 231 while pulling the handle 230 out of the trolley assembly 210. A shallow shoulder 290 that surrounds the lower half of the donut 272 may be formed along the inner surface 292 of the bases 270 and 284 of the front and back snap fit pieces 252 and 254. The bases 270 and 284 of the pieces may also be similar in shape with a rounded outer edge 294 with straight sides 296 that extend to rounded corners 298 and a flat edge 300. Along the inner surface 292 and extending from the flat edge 300 a raised portion 302 having an upper edge 304 that provides reasonably tight compression and alignment of the seat webbing 258 through the lower flat edge of the front and back pieces 252 and 254.

Figures 24, 25:
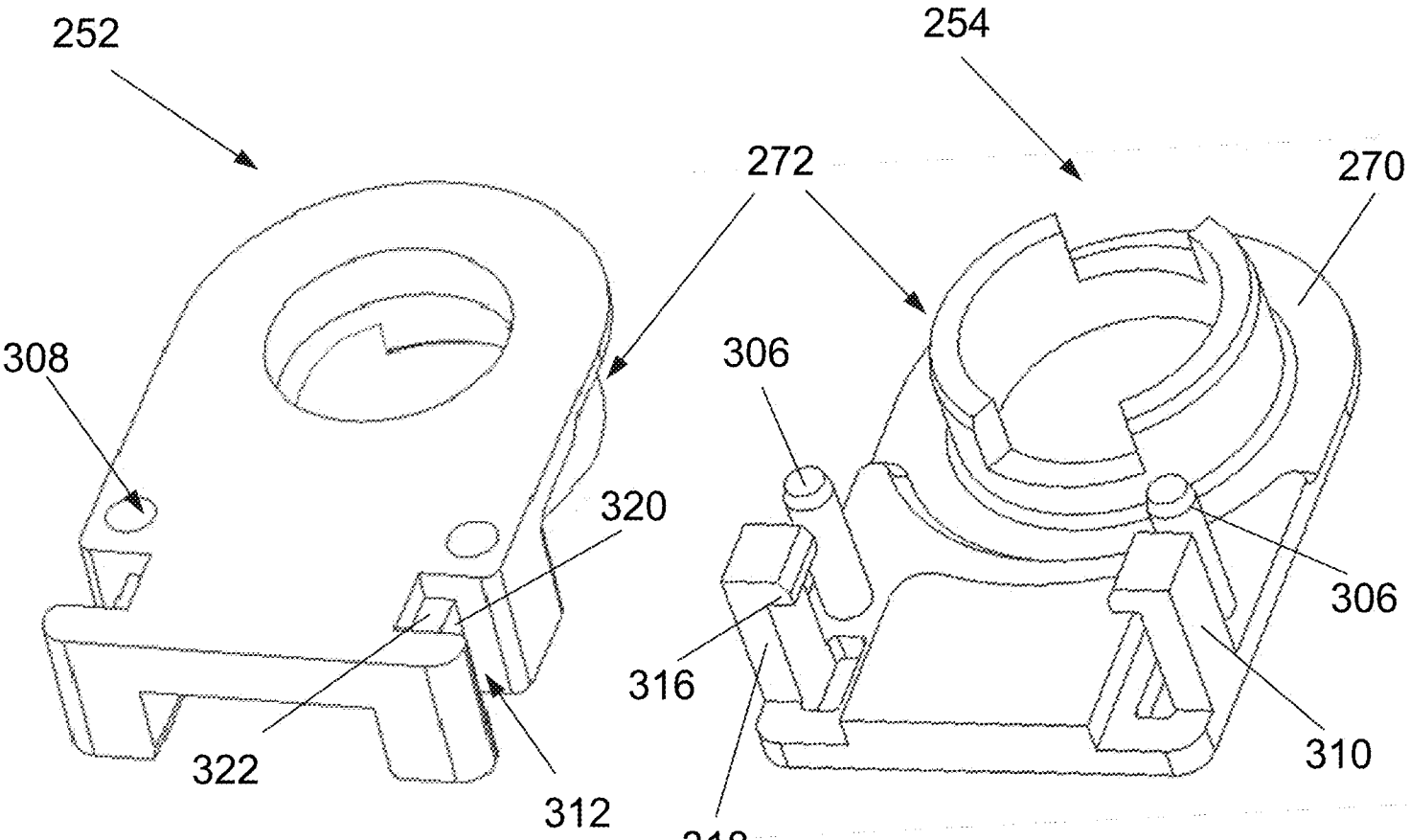
FIG. 24 is a perspective view of an embodiment of the front snap fit piece of the removable seat fixture.
FIG. 25 is a perspective view of an embodiment of the back snap fit piece of the removable seat fixture.

The front and back pieces 252 and 254 are aligned using posts 306 that may extend from either base with the posts being inserted in openings 308 in the opposing piece. The snap fit is provided using clips 310 that also may extend from either piece 252 or 254 to secure the two pieces together. As shown in FIGS. 24 and 25, posts 306 extend from the back piece 254 into openings 308 in the front piece 252 to align the pieces and clips 310 extend from the back piece 254 and are fitted into snap surfaces 312. In an embodiment, the clips 310 are secured to each snap surface 312 using a radial overhang 316 that is directed inwards towards the opposing clip 314. The radial overhang 316 that extends from the upper portion of the deflecting beam 318 that is of sufficient elasticity and rigidity to deflect around a nub 320 in the slot 312 to frictionally hold the overhang 316 against the external surface 322 of the nub 320 preventing separation of the two pieces 252 and 254. Each of the front and back pieces 252 and 254 may be formed as a single piece from strong resilient plastic such as such as nylon 6-6 polyamide using a molding or extrusion process.

Figure 27:
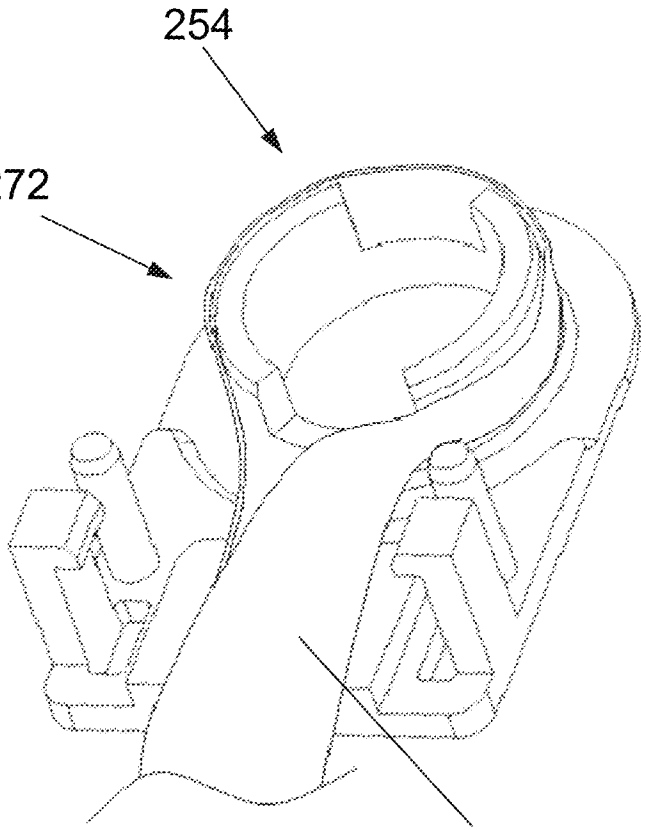
FIG. 27 is a perspective view of an embodiment of the back snap fit piece of the removable seat fixture.
Figure 26:
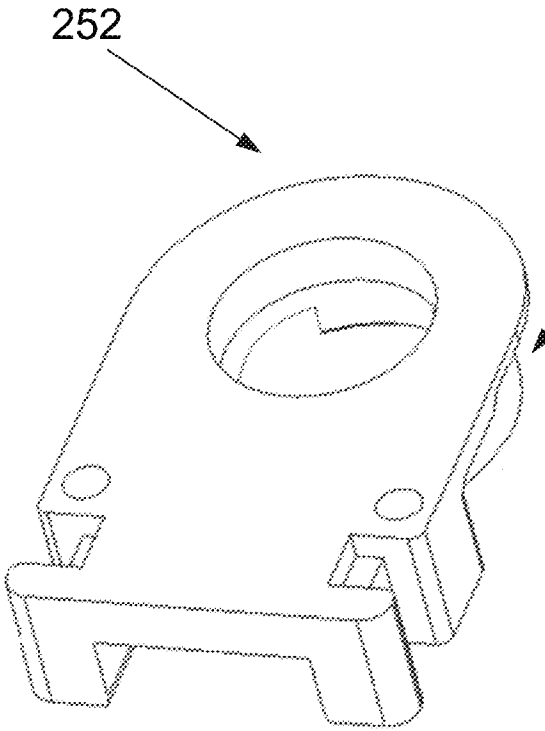
FIG. 26 is a perspective view of an embodiment of the front snap fit piece of the removable seat fixture.
Figure 28:
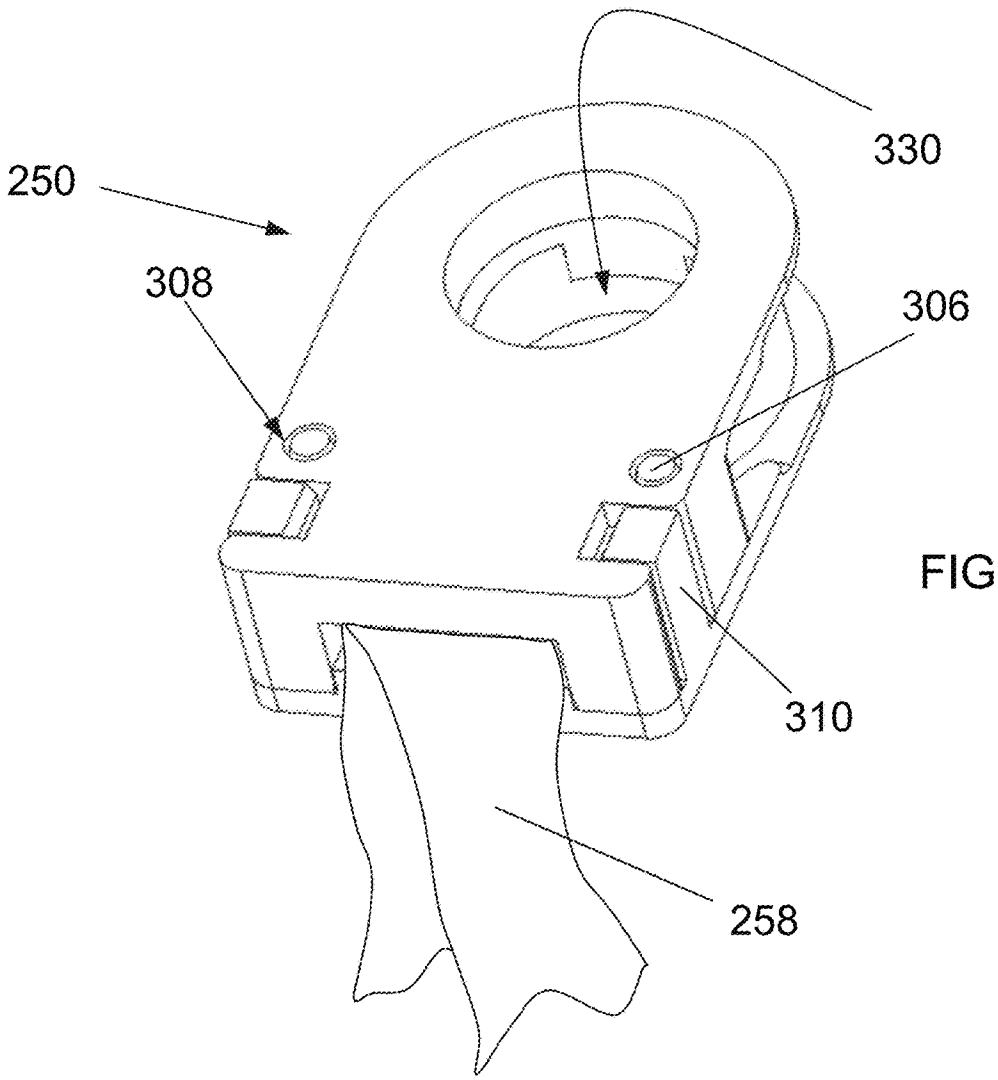
FIG. 28 is a perspective view of an embodiment of the removable seat fixture.
Figure 29:
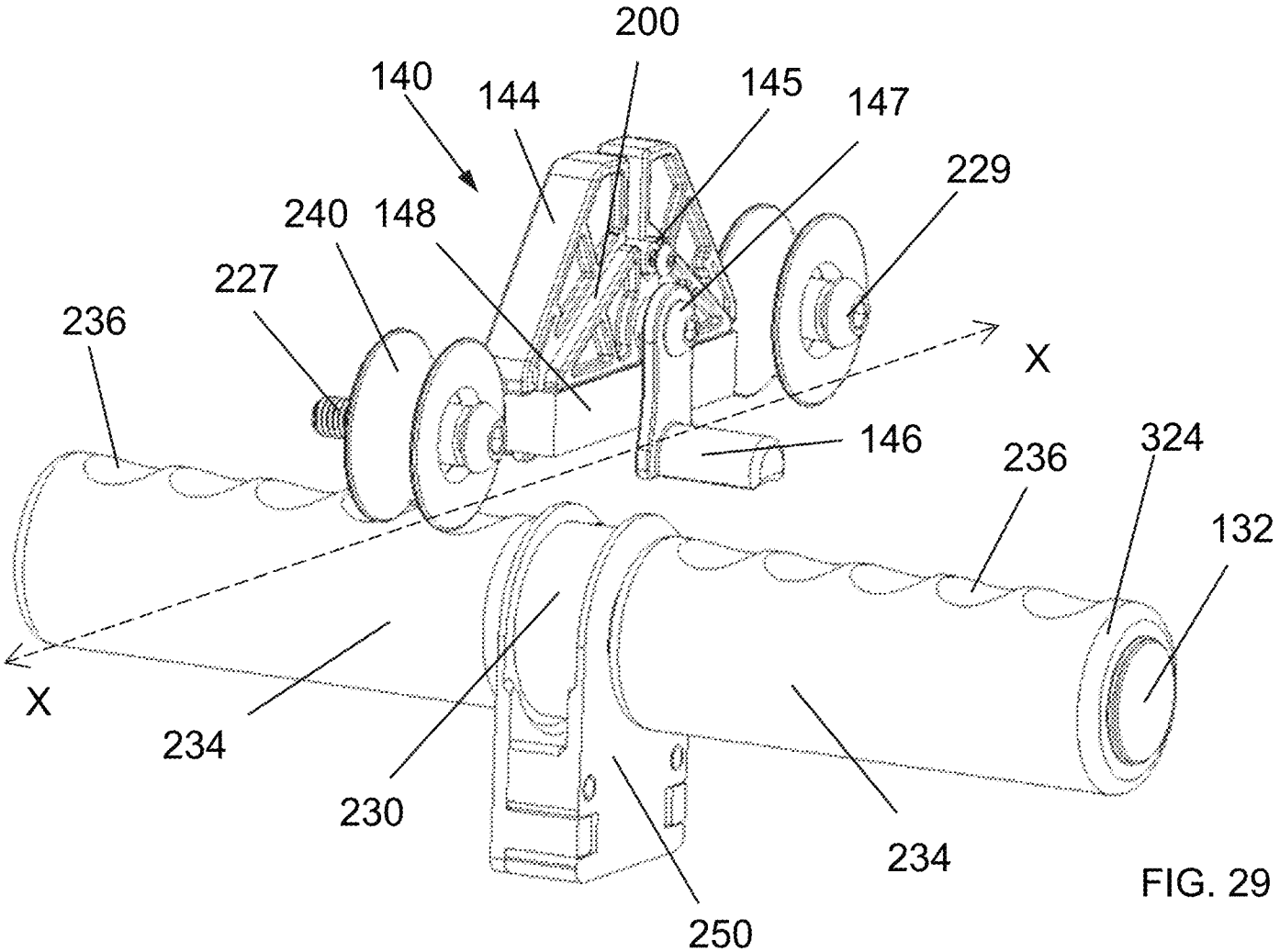
FIG. 29 is a perspective view of a further embodiment of the braking system, handle, and removable seat fixture in the further embodiment of the zip line system of the present invention.
Figure 30:
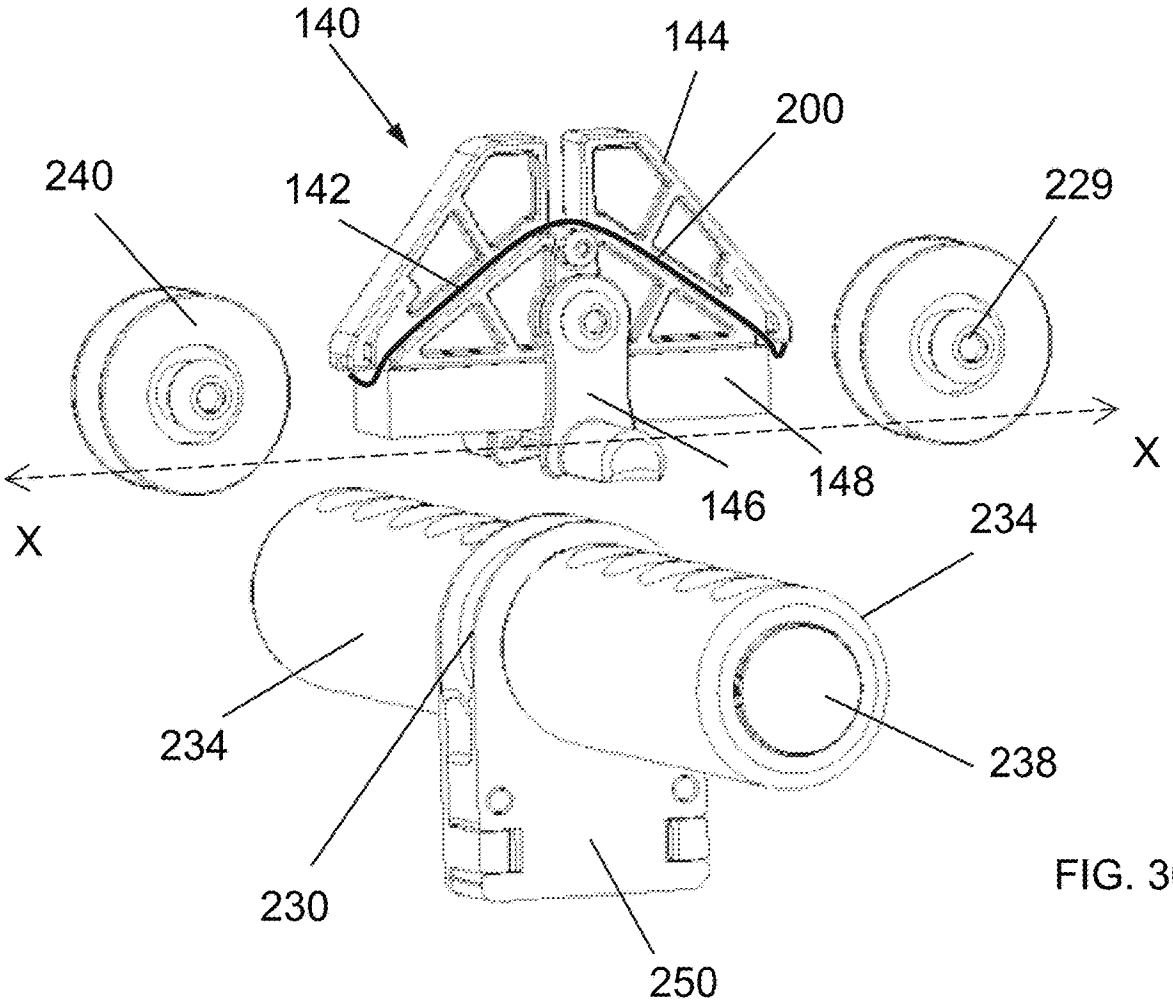
FIG. 30 is a perspective view of a further embodiment of the wheels, braking system, handle, and removable seat fixture in the further embodiment of the zip line system of the present invention.
Figure 31:
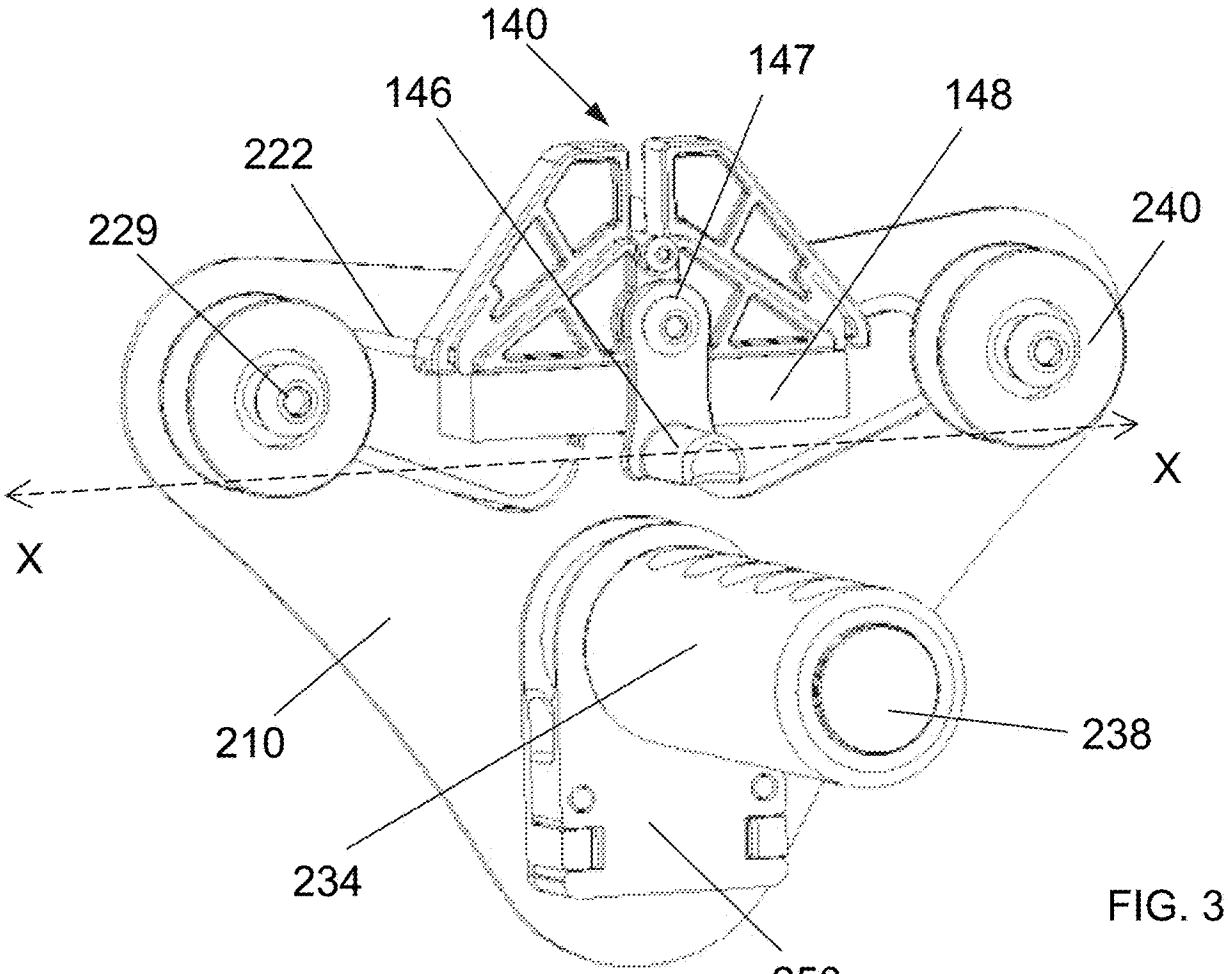
FIG. 31 is a perspective view of a further embodiment of one frame of the trolley, wheels, braking system, handle, and removable seat fixture in the further embodiment of the zip line system of the present invention.
Figure 32:
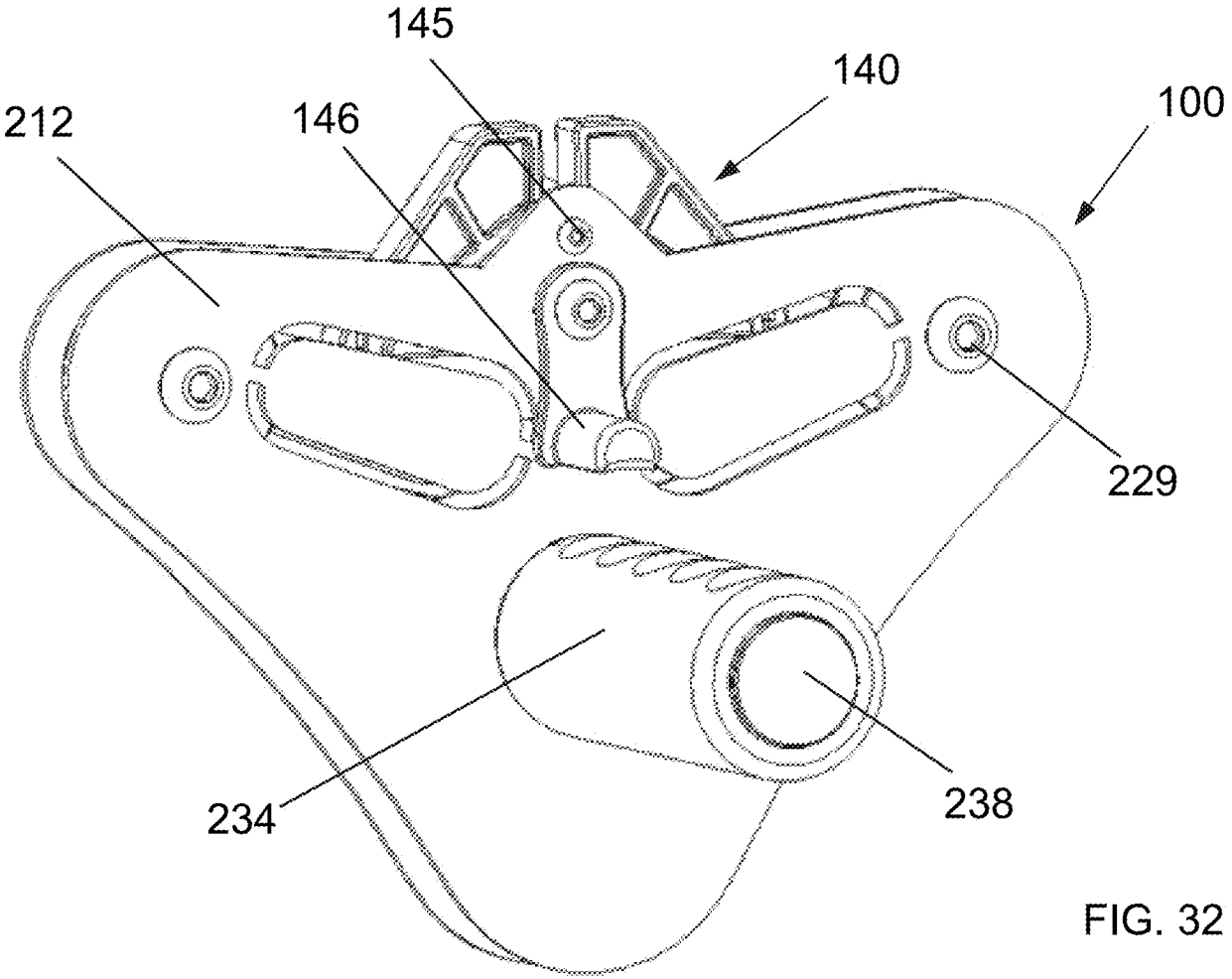
FIG. 32 is a perspective view of a further embodiment of the trolley, braking system, and handle in the further embodiment of the zip line system of the present invention.

Prior to assembly of the removable seat fixture 250 using pieces 252 and 254, the seat webbing 258 is looped around the donut 272 of one of the pieces 252 and 254 and overlapped along the raised portion 302 as shown in FIGS. 26 and 27. The posts 306 are inserted through the openings 308 and the clips 310 are expanded around the base of the nubs 320 with the overhang 316 snapped over the top surface 322 of the nub 320 within the slots 312. The layered seat webbing 258 extends out between the raised portions 302 of the front and back pieces 252 and 254 to hang out from the removable seat fixture 250 as shown in FIG. 28. The opening 330 through the upper portion of the removable seat fixture 250 is provided for the handle 230 that is shown with the grips 234 with stoppers 238 inserted in the ends 324 of the grips 234 and handle 230 in FIG. 29. In FIG. 29, the positioning of the braking system 140, wheels 240, and handle with the removable seat fixture 250 is shown from a perspective view. The axis X defines the path of the cable 14 that the wheels 240 are supported on and that the braking pad 148 of the braking system 140 is drawn down and against to slow the speed or stop the zip line system 100. A front perspective view of these components with the elastic 142 is shown in FIG. 30 and the components affixed to a frame piece 210 in FIG. 31. The second frame piece 212 is assembled to these components and the further embodiment of the zip line system 100 is shown in FIG. 32. This embodiment of the system 100 includes the distributive braking system 140 with the brake pad 148 that evenly slows the system 100 and reduces wear and tear limiting requirements to replace the brake pad 148. Further embodiments of the zip line system 100 also include the support harness assembly 101, removable seat fixture 250, and foldable seat 260 that provides for the zip line system to be completely portable so that it may be carried, installed and taken down in remote locations.

While the foregoing is directed to embodiments of the present invention, other and further embodiments of the invention may be devised without departing from the basic scope thereof. For example, although numerous embodiments having various features have been described herein, combinations of such various features in other combinations not discussed herein are contemplated within the scope of embodiments of the present invention.

What is claimed is:

1. A zip line system comprising:

a frame supported on a suspended cable;

at least one pulley supported by the frame;

a handle attached to the frame; and a braking system having a lever pin and a brake pad, the lever pin configured to pivot the brake pad towards the pulley, the brake pad configured to contact the suspended cable between the brake pad and the pulley and when activated press the brake pad against the cable and the pulley to curb the rotation of the pulley to slow the descent of the zip line system.

2. The zip line system of claim 1 wherein the brake pad having a smaller surface area that contacts the cable immediately at the pulley.

3. The zip line system of claim 2 wherein the brake pad of the braking system is replaceable.

4. The zip line system of claim 1 wherein the frame is removable from the cable by removing the handle.

5. The zip line system of claim 1 comprising a seat with a seat fixture removably attached to the frame using the handle.

6. The zip line system of claim 1 comprising a ratchet system configured to adjust tension in the suspended cable.

7. A portable zip line system comprising:

a cable assembly having a cable and ratchet system;

a trolley having an opening, the trolley configured to be supported by the cable;

a handle configured to be inserted through the trolley opening to be attached to the trolley, the handle configured to be removable by pulling the handle through the opening in the trolley to remove the trolley from the cable; and a seat affixed to a seat fixture, the seat fixture having an opening and configured to attach to the trolley by aligning the seat fixture opening with the trolley opening and inserting the handle through the trolley opening and the seat fixture opening, the seat removable from the trolley by removing the handle.

8. The portable zip line system of claim 7 wherein the trolley is removable from the cable by removing the handle and pulling the trolley up and away from the cable.

9. The portable zip line system of claim 7 wherein the trolley having at least one pulley rotatable on the cable.

10. The portable zip line system of claim 7 wherein the cable assembly is removable from two structural supports using the ratchet system.

11. The portable zip line system of claim 7 comprising a braking system with a brake pad that when activated drags the brake pad along the cable to slow the descent of the zip line system.

12. The portable zip line system of claim 11 wherein the braking system comprises a distributive structural support frame that transfers forces evenly and smoothly in slowing the zip line system.

13. The portable zip line system of claim 11 wherein the brake pad is replaceable and comprises a heat resistant material.

14. The portable zip line system of claim 11 wherein an actuator of the braking system is supported by an elastic member.

15. The portable zip line system of claim 7 wherein the handle has a releasable attachment mechanism that secures the handle to the trolley.

16. The portable zip line system of claim 7, wherein the seat is flexible and adjustable.

17. A method of assembly of a portable zip line system, comprising the steps of:

installing a cable to two structural supports using a ratchet system;

aligning at least one pulley of a trolley on the cable, the at least one pulley attached between two frames of the trolley, each frame of the trolley having an opening;

affixing a seat to a seat fixture, the seat fixture having an opening;

aligning the seat fixture between the two frames of the trolley; and inserting a handle through the opening in the trolley and the opening in the seat fixture to secure the seat to the trolley and the trolley to the cable.

18. The method of assembly of a portable zip line system of claim 17 comprising the step of removing the seat and seat fixture from the trolley by removing the handle.

19. The method of assembly of a portable zip line system of claim 17 comprising the step of removing the trolley from the cable by removing the handle and pulling the at least one pulley of the trolley up and away from the cable.

20. The method of assembly of a portable zip line system of claim 17 comprising the step of removing the cable assembly from two structural supports using the ratchet system.

21. The method of assembly of a portable zip line system of claim 17 comprising the step of affixing a braking system to the trolley.

* * * * *